US012163104B2

(12) United States Patent
Elliott et al.

(10) Patent No.: US 12,163,104 B2
(45) Date of Patent: Dec. 10, 2024

(54) BIMODAL COPOLYMER COMPOSITIONS USEFUL AS OIL MODIFIERS AND LUBRICATING OILS COMPRISING THE SAME

(71) Applicant: Chevron Oronite Company LLC, San Ramon, CA (US)

(72) Inventors: Ian G. Elliott, Vacaville, CA (US); Maryam Sepehr, San Ramon, CA (US); Sara Yue Zhang, Richmond, CA (US); David Morgan, Pleasanton, CA (US); Man Hon Tsang, Richmond, CA (US); Rainer Kolb, Kingwood, TX (US); Periagaram S. Ravishankar, Kingwood, TX (US)

(73) Assignee: Chevron Oronite Company LLC, San Ramon, CA (US)

( * ) Notice: Subject to any disclaimer, the term of this patent is extended or adjusted under 35 U.S.C. 154(b) by 0 days.

(21) Appl. No.: 16/166,219

(22) Filed: Oct. 22, 2018

(65) Prior Publication Data

US 2019/0177639 A1 Jun. 13, 2019

Related U.S. Application Data

(60) Provisional application No. 62/598,184, filed on Dec. 13, 2017.

(51) Int. Cl.
*C10M 143/00* (2006.01)
*C10M 143/02* (2006.01)
(Continued)

(52) U.S. Cl.
CPC ..... *C10M 143/04* (2013.01); *C10M 143/02* (2013.01); *C10M 143/06* (2013.01);
(Continued)

(58) Field of Classification Search
CPC ..... C10M 143/04; C10M 143/06; C10M 143/08; C10M 149/02; C10M 169/041;
(Continued)

(56) References Cited

U.S. PATENT DOCUMENTS 4,542,199 A 9/1985 Kaminsky et al.
4,752,597 A 6/1988 Turner
(Continued)

FOREIGN PATENT DOCUMENTS

CN 1346398 A 4/2002
CN 103936908 B 6/2017
(Continued)

OTHER PUBLICATIONS

China Office Action mailed on Feb. 28, 2022 issued in Application No. 201880080254.5, filed on Jun. 12, 2020, 9 pages.
(Continued)

*Primary Examiner* — Taiwo Oladapo

(57) ABSTRACT

Lubricating oil compositions are provided which contain bimodal copolymer compositions, and in particular bimodal ethylene-α-olefin copolymer compositions. The copolymer compositions comprise first and second ethylene-α-olefin copolymer components. The bimodal compositions are particularly useful as viscosity or rheology modifiers, e.g., in lubricating oil compositions. Lubricating oil compositions comprising the copolymer compositions advantageously exhibit enhanced shear stability index (SSI) and thickening efficiency (TE) values, while maintaining excellent low-temperature properties such as pour point, mini-rotary viscometer viscosity, and cold crank simulation performance.

16 Claims, 1 Drawing Sheet

(51) Int. Cl.

| | |
|---|---|
| ***C10M 143/04*** | (2006.01) |
| ***C10M 143/06*** | (2006.01) |
| ***C10M 143/08*** | (2006.01) |
| ***C10M 149/02*** | (2006.01) |
| ***C10M 169/04*** | (2006.01) |
| *C10N 20/00* | (2006.01) |
| *C10N 20/04* | (2006.01) |
| *C10N 30/00* | (2006.01) |
| *C10N 40/04* | (2006.01) |
| *C10N 40/08* | (2006.01) |
| *C10N 40/10* | (2006.01) |
| *C10N 40/25* | (2006.01) |

(52) U.S. Cl.
CPC ..... *C10M 143/08* (2013.01); *C10M 149/02* (2013.01); *C10M 169/041* (2013.01); *C10M 2203/003* (2013.01); *C10M 2205/022* (2013.01); *C10M 2205/024* (2013.01); *C10N 2020/019* (2020.05); *C10N 2020/04* (2013.01); *C10N 2030/68* (2020.05); *C10N 2040/04* (2013.01); *C10N 2040/042* (2020.05); *C10N 2040/08* (2013.01); *C10N 2040/10* (2013.01); *C10N 2040/25* (2013.01)

(58) Field of Classification Search
CPC ..... C10M 2205/022; C10M 2205/024; C10M 2203/003; C10M 2205/026; C10M 2205/028; C10N 2220/021; C10N 2220/033; C10N 2240/04; C10N 2240/08; C10N 2240/108; C10N 2240/10; C10N 2240/042; C10N 2230/68
See application file for complete search history.

(56) References Cited

U.S. PATENT DOCUMENTS

| | | | |
|---|---|---|---|
| 4,871,705 | A | 10/1989 | Hoel |
| 5,017,714 | A | 5/1991 | Welborn, Jr. |
| 5,120,867 | A | 6/1992 | Welborn, Jr. |
| 5,132,262 | A | 7/1992 | Rieger et al. |
| 5,198,401 | A | 3/1993 | Turner et al. |
| 5,243,001 | A | 9/1993 | Winter et al. |
| 5,278,119 | A | 1/1994 | Turner et al. |
| 5,278,264 | A | 1/1994 | Spaleck et al. |
| 5,296,434 | A | 3/1994 | Karl et al. |
| 5,304,614 | A | 4/1994 | Winter et al. |
| 5,324,800 | A | 6/1994 | Welborn, Jr. et al. |
| 5,334,677 | A | 8/1994 | Ewen et al. |
| 5,387,568 | A | 2/1995 | Ewen et al. |
| 5,391,617 | A | 2/1995 | Olivier et al. |
| 5,391,629 | A | 2/1995 | Turner et al. |
| 5,416,228 | A | 5/1995 | Ewen et al. |
| 5,449,651 | A | 9/1995 | Reddy et al. |
| 6,319,998 | B1 | 11/2001 | Cozewith et al. |
| 6,525,007 | B2 | 2/2003 | Okada et al. |
| 6,589,920 | B2 | 7/2003 | Okada et al. |
| 7,022,766 | B2 | 4/2006 | Okada et al. |
| 7,053,153 | B2 | 5/2006 | Schauder |
| 7,402,235 | B2 | 7/2008 | Huang |
| 7,526,642 | B2 | 4/2009 | Hurtta et al. |
| 7,622,433 | B2 | 11/2009 | Kaneshige et al. |
| 8,378,042 | B2 | 2/2013 | Yeh et al. |
| 8,378,048 | B2 | 2/2013 | Kolb et al. |
| 8,389,452 | B2 | 3/2013 | Datta et al. |
| 8,618,033 | B2 | 12/2013 | Kolb et al. |
| 8,658,556 | B2 | 2/2014 | Stewart |
| 9,006,161 | B2 | 4/2015 | Datta et al. |
| 9,127,151 | B2 | 9/2015 | Matsunaga et al. |
| 9,139,794 | B2 | 9/2015 | Kolb et al. |
| 2003/0013623 | A1 | 1/2003 | Tse et al. |
| 2013/0203640 | A1 | 8/2013 | Matsunago et al. |
| 2015/0025209 | A1 | 1/2015 | Canich et al. |
| 2015/0031831 | A1* | 1/2015 | Ravishankar ..... C08L 23/16 525/53 |
| 2020/0362263 | A1 | 11/2020 | Ravishankar |

FOREIGN PATENT DOCUMENTS

| | | |
|---|---|---|
| EP | 638611 | 2/1995 |
| EP | 1148115 | 10/2001 |
| EP | 1262498 | 12/2002 |
| EP | 1561798 | 8/2005 |
| EP | 1309656 | 8/2008 |
| JP | S62198641 A | 9/1987 |
| JP | 2003105365 A | 4/2003 |
| JP | 2012525471 A | 10/2012 |
| JP | 2014167134 A | 9/2014 |
| WO | 2013115912 | 8/2013 |
| WO | 2013126141 W | 8/2013 |

OTHER PUBLICATIONS

China Office Action mailed on Nov. 21, 2022 issued in Application No. 201880080254.5, filed on Jun. 12, 2020, 8 pages.

Europe Office Action mailed on Aug. 3, 2022 issued in Application No. 18801042.5, filed on May 27, 2020 6 pages.

Japan Office Action mailed on Oct. 13, 2022 issued in Application No. 2020-532784, filed on Jun. 12, 2020 2 pages.

PCT International Search Report and Written Opinion, mailed on Jun. 20, 2019, issued in International Application No. PCT/IB2018/058182, filed on Oct. 22, 2018, 61 pages.

Rudolphi A K et al: "4.5 Physically Bulk Active Additives", Lubricants: Introduction to properties and performance, Jan. 1, 2014 (Jan. 1, 2014), pp. 81-84, XP055946965.

* cited by examiner

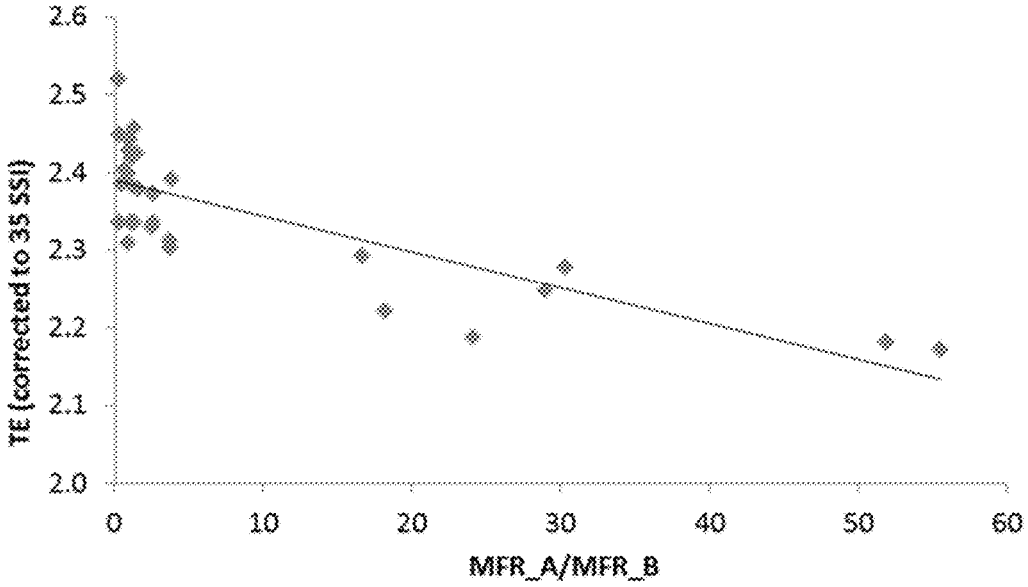
2.6
2.5
2.4
2.3
2.2
2.1
2.0
TE (corrected to 35 SSI)
0
10
20
30
40
50
60
MFR_A/MFR_B

BIMODAL COPOLYMER COMPOSITIONS USEFUL AS OIL MODIFIERS AND LUBRICATING OILS COMPRISING THE SAME

FIELD

The present disclosure relates to lubricants comprising polymer compositions, such as α-olefin copolymer compositions, processes for making such compositions, and their uses. The compositions are particularly suitable for use as additives, e.g. as rheology modifiers, in lubrication fluids and the like.

BACKGROUND

Lubrication fluids are applied between moving surfaces to reduce friction, thereby improving efficiency and reducing wear. Lubrication fluids also often function to dissipate the heat generated by moving surfaces. Such fluids include petroleum-based lubrication oils, greases, and the like. For instance, petroleum-based lubrication oils are frequently used in internal combustion engines.

Lubrication fluids such as petroleum-based lubrication oils may contain additives that help the fluid to have a certain viscosity at a given temperature. In general, the viscosity of lubrication fluids is dependent upon temperature. When the temperature of a lubrication fluid is increased, the viscosity generally decreases, and when the temperature is decreased, the viscosity generally increases. For internal combustion engines, for example, it is desirable to have a lower viscosity at low temperatures to facilitate engine starting during cold weather, and a higher viscosity at higher ambient temperatures when lubrication properties typically decline.

Additives for lubrication fluids include rheology modifiers, such as viscosity index (VI) improvers, or VIIs. VIIs, many of which are derived from α-olefin copolymers (such as ethylene-alpha-olefin copolymers, e.g., ethylene-propylene copolymers and/or other olefin copolymers) modify the rheological behavior of a lubricant to increase viscosity and promote a more constant viscosity over the range of temperatures at which the lubricant is used.

The industry continues to seek improved VIIs. For instance, a desirable VII would exhibit adequate low-temperature viscosity properties, e.g., such that a lubrication fluid comprising the VII would maintain adequately low viscosity at low temperatures, as may be demonstrated by fluid measurements such as pour point, mini-rotary viscometry (MRV), and cold-cranking simulator (CCS) testing. In addition, it is desired to maximize thickening efficiency (TE) of the VII, which is a measure of the thickening ability of a polymer in a lubrication fluid (e.g., such that greater TE indicates a smaller amount of VII may be added to achieve desired properties). However, TE is interdependent with shear stability index (SSI), and SSI needs for various VIIs vary across different lubricating oil grades and target end uses and/or markets. So, a VII desirably provides a greater thickening efficiency (TE) at a given target or desired SSI (which, again, may be different for different target uses). This means that for each SSI class of VII, such VII will desirably be designed to have maximum TE at that SSI.

As explained in U.S. Pat. No. 9,139,794 and in U.S. Pat. No. 9,127,151 (see, e.g., '151 Patent at column 5, lines 21-32), it is generally believed that the composition of an olefin copolymer VII at a given SSI largely determines the TE, and that higher ethylene content is preferred because of its higher TE. On the other hand, the '151 Patent also explains that while increasing the ethylene content of rheology modifiers leads to improved TE/SSI ratios, it also leads to increased crystallinity of the olefin copolymer, which is thought to be detrimental because crystalline polymers tend to associate. These associations are apparent as regions (e.g., "lumps") of high viscosity which give the oil a non-uniform appearance. Therefore, it would appear that one must accept trade-offs in designing an olefin copolymer VII (to achieve greater TE, one must accept higher crystallinity, thereby sacrificing low-temperature performance due to, e.g., greater gelation tendency and/or detrimentally higher SSI).

This perceived trade-off can make it very difficult to achieve desired properties in certain olefin copolymer VIIs. For instance, some specifications require extremely low pour points in lubricating engine oils, which requires minimizing a viscosity modifier's tendency toward gelation (therefore minimizing, e.g., crystallinity of the olefin copolymer). Thus, it would seem that only so much improvement could be made in maximizing TE for a given SSI (as indicated, e.g., by the ratio TE/SSI, or by using geometric ratios to determine a predicted TE—which may also be referred to as a "corrected TE" or "$TE_{corr}$"—at a given SSI based upon (1) measured TE, (2) measured SSI, and (3) target SSI different from the measured SSI), while at the same time avoiding gelation or other issues that one would otherwise expect to encounter from raising ethylene content so as to increase TE/SSI.

Some references of potential relevance include, for instance, US Patent Publication No. 2015/0031831; WIPO Publication Nos. WO2012/15572, WO2012/15573, and WO2013/115912; U.S. Pat. Nos. 5,391,617, 6,525,007, 6,589,920, 6,525,007, 7,022,766, 7,053,153, 7,402,235, 7,526,642, 7,622,433, 8,378,042, 8,378,048, 8,389,452, 8,618,033, 9,006,161, and 9,127,151; and European Patent Nos. 0638611, 1148115, 1262498, 1309656, and 1561798.

Accordingly, there is provided a lubricating oil comprising the bimodal co-polymer composition as described herein that exhibits high thickening efficiency and beneficial low temperature solution rheology properties.

SUMMARY

Contrary to conventional wisdom, it has been surprisingly discovered that one can adjust thickening efficiency (TE) of a rheology modifier olefin copolymer composition at a desired shear stability index (SSI), while advantageously maintaining key parameters of the copolymer composition relatively constant (e.g., overall ethylene content, ethylene content of the individual components, and relative amounts of each component in the copolymer composition), which also enables one to maintain SSI while improving TE, and/or to adjust a polymer production campaign to meet differing target SSI values, while ensuring adequate TE will result from the adjusted product made during a polymer production campaign. According to yet further embodiments, target SSI and/or TE can be achieved by adjusting more readily-measured properties of the polymer composition, enabling accurate and agile control of polymer production campaigns to achieve various target SSI and/or TE values.

In particular, in an ethylene copolymer composition having first and second components or fractions (e.g., components, or fractions, in a polymer blend), one can control one or more of: (1) melt flow rate of the copolymer composition (MFR, measured per ASTM D1238 at 230° C., 2.16 kg); (2) corrected Melt Flow Rate Ratio (cMFRR) of the copolymer composition, which is the ratio of (i) MFR measured per ASTM D1238 at 230° C. and 21.6 kg, divided by (ii) MFR measured per ASTM D1238 at 230° C. and 2.16 kg; (3) inter-fractional melt flow rate ratio (sometimes referred to by the shorthand "$MFR_A/MFR_B$" or abbreviated "IFMFRR," this is the ratio of the MFR of the first polymer component or fraction divided by the MFR of the second polymer component or fraction (both MFR values measured per ASTM D1238, at 230° C. and 2.16 kg)); and (4) wt % of ethylene-derived units in the composition. It has been found that any one or more of these properties may be adjusted so as to adjust TE and/or SSI. This means that, contrary to conventional wisdom, ethylene content in the composition (and/or in the fractions of the composition) may be held constant, and changes can be made to other properties of the composition to adjust the TE and/or SSI that the composition will exhibit when employed as an additive in a lubricating oil composition. Alternatively, ethylene content can be reduced in combination with other changes to MFR, cMFRR, and/or IFMFRR in order to produce a composition exhibiting similar TE and/or SSI with reduced ethylene content. In general, the present disclosure further provides an advantageous control strategy in which properties (e.g., MFR and cMFRR) that can be readily measured on-line are used to control a commercial production campaign to target TE and/or SSI values (whereas measuring the resulting TE and/or SSI would typically require off-line blending and separate measurements).

According to particular embodiments, $MFR_A$ and/or $MFR_B$ of the polymer fractions A and B can be controlled so as to modify one or more of the above-noted polymer composition characteristics. In particular of these embodiments, $MFR_A/MFR_B$ may be controlled so as to obtain a bimodal ethylene copolymer composition having $MFR_A/MFR_B$ at or near 1 (or possibly less), such as within the range from 0.5 to 1.5, or 0.5 to 3.0. On the other hand, according to some embodiments, increased $MFR_A$ (and therefore increased $MFR_A/MFR_B$) may provide advantages such as a lower tendency for lubricating oil compositions to gel in certain industrial and motor applications. Further, very high $MFR_A$ (and therefore very high $MFR_A/MFR_B$) may provide additional benefits such as a low likelihood to cause filter plugging in certain instances in which a lubricating oil composition is employed. Thus, certain embodiments include $MFR_A/MFR_B$ within the range from 0.5 to 75.0, such as from 1.5 to 6.0, 1.75 to 5.0, or, 10 to 75, such as from 15 to 60, with ranges from any lower limit to any upper limit also contemplated. These embodiments may, among other things, provide advantageous balance between (1) high TE and (2) decreased propensity to undesirable gelation and filter plugging, particularly where $MFR_A$ (MFR of the first polymer fraction) is 10 g/10 min (ASTM D1238, 230° C., 2.16 kg) or greater. Intermediate $MFR_A/MFR_B$ values may further be useful to avoid gelation, while accepting some risk of filter plugging in order to achieve the benefit of greater TE achieved by lower $MFR_A/MFR_B$ values.

Accordingly, the invention in some aspects includes an olefin copolymer composition, and in particular embodiments a bimodal ethylene copolymer composition, comprising a first α-olefin copolymer component or fraction (which may sometimes referred to as "component A" or "fraction A" herein, further noting that component and fraction may be used interchangeably) and a second α-olefin copolymer component (which may sometimes be referred to as "component B" or "fraction B" herein). Each α-olefin copolymer component is comprised of two or more α-olefin-derived units, preferably ethylene and a $C_3$-$C_{20}$ α-olefin (preferably propylene, 1-hexene, and/or 1-octene), although any combination of two or more $C_2$-$C_{20}$ α-olefin monomers may be used to produce either or both of the first and second α-olefin copolymer components. According to some embodiments, the polymer composition comprises 40 to 60 wt % of the first α-olefin copolymer component, and from 40 to 60 wt % of the second α-olefin copolymer component. Further, in certain embodiments, at least one, preferably both, of the α-olefin copolymer components comprise ethylene-derived units. In particular embodiments, component A has greater ethylene content than component B; e.g., component A may comprise 60 to 80 wt % ethylene-derived units; and component B may comprise 40 to 60 wt % ethylene-derived units. Overall ethylene contents of such copolymer compositions may be within the range from 50 to 70 wt % on the basis of total weight of the polymer composition.

According to some embodiments, the copolymer compositions find use as additives in lubricating oil compositions, grease compositions, and the like. For instance, the polymer compositions may be employed as viscosity modifiers in such compositions. Such compositions may advantageously exhibit a high ratio of TE/SSI, while still demonstrating excellent low temperature qualities (e.g., low pour point), and avoiding gelation.

In some further aspects, the present disclosure provides methods of making such copolymer compositions, such as series, parallel, or single-reactor polymerization reactions. Polymerization processes of some embodiments advantageously include controlling such polymerizations, e.g., based at least in part upon any one or more of the previously-described polymer composition properties. Such processes may include forming an initial copolymer composition at a first time, subsequently adjusting polymerization conditions so as to obtain an adjusted copolymer composition having one or more of the following properties changed as compared to the initial copolymer composition: (1) MFR of the copolymer composition; (2) cMFRR of the copolymer composition; (3) and $MFR_A/MFR_B$. The ethylene content of the adjusted copolymer composition may be virtually the same (e.g., within 5 wt % or less, preferably 2 wt % or less) of the ethylene content of the initial copolymer composition. Lubricating oil compositions employing the adjusted copolymer composition as a viscosity modifier may exhibit a different TE and/or SSI than un-adjusted lubricating oil compositions comprising the initial copolymer composition, but which are otherwise identical to the adjusted lubricating oil composition. Such processes could be employed advantageously in shifting product campaigns between similar polymer products, particularly where differing SSI and/or TE is necessary.

In other aspects, there is provided a lubricating oil comprising (1) at least 50 wt % of a base oil, based on the weight of the lubricating oil; and (2) the bimodal copolymer composition described herein.

The lubricating oil may be a crankcase lubricating oil, a marine engine oil, an automatic transmission fluid, a tractor fluid, a hydraulic fluid, a power steering fluid, a gear lubricant, or a pump oil.

Still other objects and advantages of the present disclosure will become readily apparent by those skilled in the art from the following detailed description, wherein it is shown and described only in the preferred embodiments, simply by way of illustration of the best mode. As will be realized, the disclosure is capable of other and different embodiments, and its several details are capable of modifications in various obvious respects, without departing from the disclosure.

Accordingly, the description is to be regarded as illustrative in nature and not as restrictive.

DESCRIPTION OF THE DRAWINGS

FIG. 1 is a graph showing TE vs. $MFR_A/MFR_B$ values for copolymer compositions in connection with Example 1.

DETAILED DESCRIPTION

As described above, the present disclosure in some embodiments relates to α-olefin copolymer compositions comprising a first α-olefin copolymer component (A) and a second α-olefin copolymer component (B). The first and second α-olefin copolymer components may in particular embodiments have $MFR_A$ and $MFR_B$, respectively, such that $MFR_A/MFR_B$ (or "IFMFRR") is generally within the range from 0.2 to 75, such as 0.5 to 50 or 1.5 to 40 (with any low end to any high end contemplated in various embodiments). Within these general ranges, certain embodiments include: (1) high $MFR_A/MFR_B$, such as 10.0 or greater, e.g., within the range from a low of 10, 12, 15, 17, or 20 to a high of 25, 30, 35, 40, 45, 50, 55, 60, 65, 70, or 75, with ranges from any of the foregoing lows to any of the foregoing highs contemplated; (2) low $MFR_A/MFR_B$, such as about 1.0, or within the range from a low of 0.2, 0.5, 0.7, or 0.9 to a high of 1.1, 1.2, 1.5, 3.0, or 6.0, with ranges from any of the foregoing lows to any of the foregoing highs contemplated; and (3) intermediate $MFR_A/MFR_B$, such as within the range from a low of 0.5, 1.0, or 1.5 to a high of 3, 4, 5, or 6, with ranges from any of the foregoing lows to any of the foregoing highs contemplated. High $MFR_A/MFR_B$ embodiments may be particularly suited for avoiding both filter plugging and gelation when the copolymer composition is employed as a viscosity modifier in lubricating oil compositions. Low $MFR_A/MFR_B$ embodiments, on the other hand, achieve maximized TE. Intermediate $MFR_A/MFR_B$ embodiments may provide lubricating oil compositions that avoid gelation, while accepting some risk of filter plugging to obtain the benefits of relatively higher TE.

The polymers may be formed by metallocene catalyzed polymerization reactions, meaning that the two or more types of monomers used to produce each copolymer are polymerized in the presence of one or more activated metallocene catalysts.

Most preferably, the polymer compositions are series reactor blends, meaning that the first α-olefin copolymer component is produced in a first series polymerization reaction zone, and polymerization effluent comprising the first α-olefin copolymer component is provided to a second polymerization reaction zone, wherein the second α-olefin copolymer component is produced. The first polymerization reaction zone comprises a first metallocene catalyst (in its activated form). The second polymerization reaction zone preferably comprises a second metallocene catalyst (also in activated form), which may be the same as or different from the first metallocene catalyst. However, it is also contemplated that the first metallocene catalyst from the first polymerization zone may be provided to the second polymerization reaction zone in the effluent from the first reaction zone; additional catalyst may or may not be provided to the second polymerization reaction zone.

It is furthermore also contemplated that the two α-olefin copolymer components could be produced by, e.g., parallel polymerization reactions (with post-reaction blending), and/or by polymerization in a single polymerization reaction zone (e.g., in the presence of at least two metallocene catalyst systems).

The polymer compositions are particularly suitable as additives in lubricating oil compositions, greases, and the like. According to certain embodiments, the polymer compositions may be employed as viscosity modifiers (also referred to as viscosity index improvers or VIIs, and/or as rheology modifiers), a particular sub-type of additive, in lubricating oil compositions and the like.

The polymer compositions and methods for making them are described in greater detail herein below, followed by description of control strategies particularly useful in implementing such polymerization methods, as well as description of lubricating oil compositions in which such compositions may be particularly suitable.

Definitions and Measurement Methods

For purposes of this disclosure and the claims herein, the definitions set forth below are used.

As used herein, the term "copolymer" includes any polymer having two or more monomers.

As used herein, an "ethylene-based" copolymer refers to a copolymer that intentionally includes ethylene as a monomeric unit (e.g., more than trace amounts, such as at least 1 wt % ethylene-derived units). This term is not intended to imply that the copolymer is majority-ethylene, except as may be expressly stated otherwise in context herein.

As used herein, the term "MWD" means the molecular weight distribution, or ratio of weight-average molecular weight ($M_w$) to number-average molecular weight (Ma). Unless other measurement techniques are specified, $M_w$ should be measured according to the light-scattering (LS) technique described in paragraphs [0038]-[0042] of PCT Application No. PCT/US16/66803, filed Dec. 15, 2016; and $M_n$ should be measured according to the DRI technique described in the same paragraphs of that application, which are incorporated herein by reference.

Many embodiments make reference to ethylene content of various copolymers. Ethylene content may be determined by any suitable method, but should multiple methods provide conflicting results, results determined using FTIR according to ASTM D3900 should govern.

Unless otherwise specified, melt flow rate (MFR) should be measured according to ASTM D1238 condition L (230° C./2.16 kg), and reported in g/10 min (or dg/min). In some instances (such as for determining melt flow rate ratio, MFRR), MFR may be specified as measured at 230° C./21.6 kg, according to ASTM D1238 procedures.

"MFRR," as noted, is melt flow rate ratio. This refers to the ratio of (1) MFR determined at 230° C., 2.16 kg (in g/10 min) to (2) MFR determined at 230° C., 21.6 kg (in g/10 min). Each MFR of this ratio is otherwise measured in accordance with ASTM D1238. A "corrected MFRR" or "cMFRR" may be reported, as well. This is because the MFRR value tends to depend upon the MFR (e.g., such that MFRR changes for different MFR (230° C./2.16 kg) values). The correction removes the MFR dependency to give a better idea of a given polymer composition's expected MFRR across various MFR values. For purposes herein, MFRR is normalized to a reference MFR of 4.3 g/10 min (230° C./2.16 kg), and may be calculated by the formula: $cMFRR=MFRR\ (4.3/MFR)^{-0.198}$, where MFRR and MFR are the measured MFRR and MFR values determined as just described.

As used herein, the terms "first" and "second" in reference to a component (e.g., a "first hydrogen" or a "second hydrogen") are intended solely as identifiers, and are not intended to suggest or require that the components be different (unless expressly provided otherwise). Further, references herein to a copolymer composition having first and second components (e.g., the first ethylene-α-olefin component and the second ethylene-α-olefin component) mean that the copolymer composition is bimodal. The term "bimodal" as used herein refers to compositional bimodality, meaning the composition is comprised of fractions having different comonomer contents; or, put in other words, the polymer composition has bimodal comonomer distribution. Such bimodality may be determined by known conventional means such as by using CRYSTAF. For instance, a CRYSTAF Peak Temperature Determination may be conducted using a CRYSTAF instrument available from PolymerChar (Valencia, Spain). The copolymer sample is dissolved at 150° C. in trichlorobenzene to a concentration of 0.1 wt %. The copolymer is dissolved at this temperature for 45 minutes. The solution is then kept at 100° C. for 30 minutes, whereafter it is cooled to 30° C. at a rate of 0.2° C./min. At regular intervals during cooling (e.g., preferably at least once per 15 minutes, such as once per minute, once per 5 minutes, or once per 10 minutes—with lower time intervals leading to greater accuracy), an infrared detector measures the concentration of polymer in solution. A curve of polymer concentration as a function of temperature is obtained from these measurements. The derivative of this curve is the comonomer distribution. Species with high comonomer content correspond to a low temperature peak while species with lower comonomer content are represented by a high temperature peak. The copolymers of the present disclosure, prepared as described below, display (at least) two distinct peaks, indicating a bimodal comonomer distribution. In the particular case of embodiments wherein the polymer composition is made by series reactor polymerization processes such that the copolymer composition is a series reactor blend (described in more detail below), then the first polymer component may furthermore be identified as the polymer product of the first series polymerization reaction.

For purposes of this specification and the claims appended thereto, when a polymer or copolymer is referred to as comprising an alpha-olefin (or α-olefin), including, but not limited to ethylene, propylene, and 1-butene, the olefin present in such polymer or copolymer is the polymerized form of the olefin. For example, when a copolymer is the to have an "ethylene" content of 60-80 wt %, or to comprise "ethylene-derived units" at 60-80 wt %, it is understood that the mer unit in the copolymer is derived from ethylene in the polymerization reaction and the derived units are present at 60-80 wt %, based upon the weight of the copolymer.

Thickening Efficiency is a measure of the thickening ability of a polymer in oil, and is defined as $TE=2/c\times\ln((kv_{(polymer+oil)})/kv_{oil}/\ln(2)$, where c is the concentration of the polymer (in terms of mass polymer, in g, per 100 g of oil) and kv is kinematic viscosity at 100° C. determined according to ASTM D445. The Shear Stability Index (SSI) is an indication of the resistance of polymers to permanent mechanical shear degradation in an engine. The SSI can be determined by passing a polymer-oil solution for 30 cycles through a high shear Kurt Orbahn diesel injection apparatus according to the procedures in ASTM D6278. The SSI of a polymer can be calculated from the viscosity of the oil without polymer and the initial and sheared viscosities of the polymer-oil solution using: $SSI=100\times(kv_{(polymer+oil),\ fresh}-kv_{(polymer+oil),\ sheared})/(kv_{polymer+oil),\ fresh}-kv_{oil,\ fresh})$. In general, lower SSI means that the polymer degrades less when subjected to high-shear. However, differing regions around the world specify different SSI values for lubricating oil compositions and for different applications, meaning that various SSI targets may be desired.

MRV (mini-rotary viscometer) testing, referenced using the shorthand "MRV," is carried out according to ASTM D4684.

Cold-cranking simulator (CCS) testing is carried out in accordance with ASTM D5293, which is a revision to ASTM D2602. CCS viscosity may be tested at different temperatures for different SAE (Society of Automotive Engineer) viscosity grades. For instance, 0W grades are tested at −35° C.; 5W grades at −30° C.; 10W grades at −25° C.; 15W grades at −20° C.; 20W grades at −15° C., and 25W grades at −10° C. CCS viscosity is reported in mPas.

Copolymer Compositions

As noted, the copolymer compositions of various embodiments comprise both a first ethylene-α-olefin copolymer component and a second ethylene-α-olefin copolymer component. Overall ethylene content of the copolymer compositions may vary from 15 to 85 wt %, such as within the range from a low of any one of 20, 25, 30, 35, 40, 45, 50, and 55 wt % to a high of any one of 50, 55, 60, 65, 70, 75, and 80 wt %, provided the high end of the range is greater than the low end. Thus, for instance, ethylene content may be within the range from 40 to 60, 65, or 70 wt %, or from 50 to 60 wt %, or from 20 to 50 wt %, etc. Further, in certain embodiments, the copolymer composition may have ethylene content within the range from 50, 53, or 55 wt % to 60 wt %, or from 50, 53, or 55 wt % to less than 60 wt %. In yet other embodiments, the copolymer composition may have ethylene content on the higher end, such as within the range from 60 to 80 wt %, 60 to 69 wt %, or 60 to 65 wt %. Such embodiments may provide better TE, but pour point and MRV performance may be concomitantly reduced, such that, even with the better TE of higher-ethylene embodiments, it may be preferred to keep ethylene content below 60 wt %.

The copolymer composition exhibits one or more, preferably two or more, most preferably three, four, or even all of the following properties:

- Corrected Melt Flow Rate Ratio (cMFRR) defined as the ratio of the MFR measured at 230° C./21.6 kg and at 230° C./2.16 kg (corrected as described above), within the range from 25 to 45, such as 29 to 43 g/10 min. Some embodiments preferably have higher MFRR, such as within the range from 34, 35, 36, 37, or 38 to 43, 44, or 45 g/10 min. Other embodiments (and particularly those with higher ethylene content, e.g., within the range from 60 to 65 or 69 wt %) may have lower MFRR (e.g., within the range from 25, 28, or 29 to 35 g/10 min).
- Melt Flow Rate (MFR), measured by ASTM D1238 condition L (230° C./2.16 kg) within the range from 1.0 to 6.0, 5.0, 4.0, or 3.0 g/10 min. In some embodiments, MFR of the copolymer composition may be within the range from 1.0 to 2.0 g/10 min. MFR of yet other embodiments, particularly those having higher ethylene content (e.g., from 60 to 65 wt %), may be within the higher range from 1.5, 2.0, or 2.5 g/10 min to 5.0 or 5.5 g/10 min.
- Weight-average molecular weight ($M_w$) within the range from 95,000 to 200,000 g/mol, such as within the range from 98,000 to 165,000, or from 100,000 to 150,000, such as 105,000 or 110,000 to 130,000 or 145,000; with ranges from any of the foregoing low ends to any of the foregoing high ends also contemplated in various embodiments.

Number-average molecular weight (Ma) within the range from 46,000, 48,000, or 50,000 g/mol to 60,000, 62,000, 64,000, 65,000, 70,000 or 75,000 g/mol, with ranges from any of the foregoing lows to any of the foregoing highs contemplated.

Melting point ($T_m$) as determined by differential scanning calorimetry (DSC) that is greater than 3.31*E−186 (in ° C.), where E is the ethylene content of the copolymer composition, for copolymer compositions having ethylene content less than 60 wt %. The $T_m$ of such embodiments may be such that the copolymer composition has a peak melting point by DSC (described below) within the range from a low of any one of 10° C., 20° C., or 25° C. to a high of any one of 40° C., 45° C., 50° C., 60° C., 70° C., or 80° C., such as within the range from 20° C. to 45° C., 20° C. to 70° C., 25° C. to 50° C., etc.

In alternative embodiments in which ethylene content of the copolymer composition is 60 wt % or greater (e.g., those having 60 to 65 wt % ethylene as noted above), the copolymer composition may exhibit melting point by DSC that is also greater than 3.31*E−186 (in ° C.), and/or which is within the range from a low of any one of 20° C., 25° C., 30° C., or 35° C. to a high of any one of 40° C., 45° C., 50° C., 55° C., 60° C., 70° C., 80° C., or 90° C., such as within the range from 25° C. to 50° C.

DSC measurements of the melting temperature, $T_m$, of the ethylene copolymers are determined using a Perkin Elmer Diamond DSC (heat compensation type furnace). Between 10 and 15 mg of a polymer is sealed in a pan with a hermetic lid and loaded into the instrument. In a nitrogen environment, the sample is first heated to 150° C. at approximately 100° C./min. The sample is then equilibrated (kept) at 150° C. for 5 minutes to erase its thermal history. Crystallization data (first cool) is acquired by cooling the sample from the melt to −70° C. at 10° C./min. Finally, the sample is heated again to 150° C. at 10° C./min to acquire additional melting data (second heat). The endothermic melting transition (second heat) and exothermic crystallization transition (first cool) are analyzed for peak temperature. The term "melting peak" as used herein, is the highest peak among principal and secondary melting peaks as determined by DSC during the second melt described above. The melting point is recorded as the temperature of the greatest heat absorption within the range of melting of the sample.

Further, in certain embodiments, $MFR_A/MFR_B$ of the copolymer composition is in accordance with the desired ranges of $MFR_A/MFR_B$ for various embodiments previously described (in addition to having the one or more properties just noted).

Ethylene-α-Olefin Copolymer Components

The copolymer compositions of various embodiments comprise 30 to 70 wt %, such as 40 to 60 wt % of the first ethylene-α-olefin copolymer component, or even 40 to 50 wt %, or even 42 to 48 wt % of the first component. The second ethylene-α-olefin component is present within the range from 30 to 70 wt %, such as 40 to 60 wt %, 50 to 60 wt %, or even 52 to 58 wt %, based on the total weight of the copolymer composition. Copolymer compositions of some embodiments comprise more second ethylene-α-olefin component than first ethylene-α-olefin component. Further, the first ethylene-α-olefin copolymer component preferably has greater ethylene content than the second ethylene-α-olefin copolymer component. In some embodiments, the first component may have at least 3, at least 5, at least 7, at least 10, at least 15, or at least 20 wt % more ethylene content than the second component (measured as the difference between the first component's ethylene wt % and the second component's ethylene wt %, i.e., such that a first component with 65 wt % ethylene has 15 wt % more ethylene content than a second component with 50 wt % ethylene content, each ethylene content based on the total weight of the individual component).

The first and second ethylene-α-olefin copolymers each comprise ethylene and one or more α-olefin comonomers. The α-olefin comonomers are selected from the group consisting of $C_3$ to $C_{20}$ alpha-olefins and mixtures thereof. Preferably, the comonomer in each copolymer is propylene, 1-butene, 1-hexene, 1-octene or mixtures thereof.

The first ethylene-α-olefin copolymer component has ethylene content within the range from 50 to 85 wt %, such as 60 to 80 wt %, 67 to 78 wt %, or 65 to 75 wt %, based on the weight of the first ethylene-α-olefin copolymer component, with ranges from any of the foregoing low ends to any of the foregoing high ends also contemplated in various embodiments.

The first ethylene-α-olefin copolymer component's MFR (ASTM D1238, condition L (230° C./2.16 kg)), which may also be referred to as $MFR_A$, may be within the range from 0.5 to 25 g/10 min. In certain embodiments, the first ethylene-α-olefin copolymer component's MFR (ASTM D1238, condition L (230° C./2.16 kg)) may be within the range from a low of any one of 0.5, 0.6, 0.7, or 0.8 to a high of any one of 1.5, 1.7, 2.0, 2.5, 3.0, 3.5, 4.0, 4.5, 5.0, 5.5, 6.0, 7.0, 8.0, 9.0, or 10.0 g/10 min.

In yet other embodiments, as previously noted, one may opt for a higher $MFR_A$ of the first ethylene-α-olefin copolymer component (e.g., to minimize propensity toward gelation), although this may lower TE where the higher $MFR_A$ results in a higher $MFR_A/MFR_B$ or IFMFRR value. According to such embodiments, $MFR_A$ may be within the range from a low of any one of 10, 12, or 14 to a high of any one of 16, 18, 20, or 25 g/10 min (ASTM D1238, condition L (230° C./2.16 kg)).

As previously noted, high-MFR first fraction embodiments may be particularly useful in avoiding gelation and/or filter plugging in certain instances wherein the polymer composition is employed as a viscosity modifier (e.g., in lubricating oil compositions). It has been found that it is preferable that the first, higher-ethylene, fraction be controlled to such higher MFR values. This is particularly important in series reaction polymerizations in which the first component is made in the first in a series of two polymerization reaction zones, in order to ensure accurate control of the MFR of this component. Moreover, the higher-ethylene component is more likely to contribute significantly to gelation and/or filter plugging due to its higher ethylene content. Without wishing to be bound by theory, it is believed that by utilizing particularly high MFR (i.e., shorter average polymer chains) in the first (higher-ethylene-content) component, and blending with the lower-ethylene component, it is difficult for the high-ethylene fraction to form gels when employed as a viscosity modifier. The second (lower ethylene) component may optionally have lower or similar MFR to the first component; it is believed the anti-gelation and/or anti-filter plugging effects can be achieved either way.

The second ethylene-α-olefin copolymer component has ethylene content within the range from 20 to 70 wt %, such as 30 to 60 wt %, or 40 to 55 wt % or even 40 to 50 wt %, based on the weight of the second ethylene-α-olefin copolymer component, and with ranges from any of the foregoing low ends to any of the foregoing high ends also contemplated in various embodiments. In yet other embodiments (particularly those in which the overall copolymer composition has ethylene content within the range of 60 to 65 or 69 wt %), ethylene content of the second ethylene-α-olefin copolymer component is within the range from 50 to 60 wt %, such as 52 to 57 wt %.

MFR (ASTM D1238, condition L (230° C./2.16 kg)) of the second ethylene-α-olefin copolymer component is within the range from a low of 0.1, 0.5, 1.0, or 1.5 to a high end of 0.75, 0.8, 0.85, 0.9, 0.95, 0.99, less than 1.0, 1.0, 1.5, 1.75, 2.0, 2.5, 3.0, or 3.5. In certain embodiments (such as those in which the copolymer composition has high ethylene content of 60 to 65 wt %), MFR of the second ethylene-α-olefin copolymer may be even higher, such as within the range from 0.5, 1.0, or 1.5 to 10.0.

In high-$MFR_A$ embodiments (e.g., those having $MFR_A$ of the first ethylene-α-olefin copolymer component of 10 or greater), it is preferred that MFR of the second ethylene-α-olefin copolymer ($MFR_B$) be less than or equal to 1.0, preferably less than 1.0, so that the MFR of the overall polymer blend is within the range from 1.5 to 2.5, which has been found to be suitable for polymer blends that exhibit SSI of about 32 to about 40 when employed as viscosity modifiers. $MFR_B$ in such embodiments may be within the range from a low of about 0.1 or 0.5 to a high of about 0.5, 0.75, 0.8, 0.85, 0.9, 0.95, 0.99, less than 1.0, or 1.0, with ranges from any of the foregoing low ends to any of the foregoing high ends contemplated.

In certain embodiments, the polymer composition is a series reactor blend, and in particular a reactor blend of two series polymerization reactors, such that the first ethylene-α-olefin copolymer component corresponds to the product of the first series polymerization reactor. The effluent of the first series polymerization reactor is provided to the second series polymerization reactor, and optionally additional monomer and/or catalyst are likewise provided to the second reactor. The effluent of the second polymerization reactor of such embodiments therefore contains both (1) unreacted polymer from the first reactor effluent, which, as noted, corresponds to the first ethylene-α-olefin copolymer component and (2) additional polymer formed in the second reactor (which may include polymer from the first reactor further polymerized in the second reactor), and which further corresponds to the second ethylene-α-olefin copolymer component. In such embodiments wherein the first polymerization reactor effluent comprises the first ethylene-α-olefin copolymer component and the second polymerization reactor effluent comprises the first and second ethylene-α-olefin copolymer components, direct measurement of monomer content and MFR of the second ethylene-α-olefin copolymer component is difficult, if not impossible. This is because, in such embodiments, there is no product stream comprising the second copolymer component which does not also comprise the first copolymer component. However, the monomer content and MFR of the second component may be calculated from, respectively, (1) the monomer contents and (2) the MFR of the first component and the overall copolymer composition.

Thus, in embodiments in which the copolymer composition is a series reactor blend, the amount of units derived from a given monomer X in the second ethylene-α-olefin copolymer component of the reactor blend may be determined using the relationship:

$$X_{blend}=n_A X_A+n_B X_B \quad (1)$$

where $X_{blend}$ is the content (in wt %) of units derived from monomer X in the blend of two polymers A and B each having individual content (in wt %) of units derived from monomer X of $X_A$ and $X_B$, respectively; and $n_A$ and $n_B$ represent the weight fractions of components A and B in the blend. With known monomer content for the blend and for the first ethylene-α-olefin copolymer component (e.g., component A in Equation (1)), and with known polysplit (i.e., wt % s of the first and second ethylene-α-olefin components in the blend), the monomer content of the second ethylene-α-olefin component (e.g., component B in Equation (1)) may readily be calculated.

Likewise, the MFR of the second ethylene-α-olefin copolymer component may be calculated in a similar manner. In particular, MFR of the second copolymer component may be calculated using the relationship:

$$\log MFR=n_A \log MFR_A+n_B \log MFR_B \quad (2)$$

where MFR is the MFR (ASTM D1238, condition L (230° C./2.16 kg)) of the blend of two polymers A and B each having individual MFR values $MFR_A$ and $MFR_B$, respectively; and $n_A$ and $n_B$ represent the weight fractions of components A and B in the blend. Thus, with known polysplit and known (measured) $MFR_A$ of component A (the product of the first series polymerization, which may be withdrawn and measured for $MFR_A$ according to ASTM D1238), as well as measured MFR of the final product, $MFR_B$ of component B may be calculated per Equation (2).

Crystallinity

In certain embodiments, X-Ray Diffraction (XRD) may be used to determine the crystallinity of (a) the copolymer composition, and/or either of the first or second fractions of the copolymer composition. The method for determining % crystallinity using XRD follows the description set forth in paragraphs [0130]-[0132] of U.S. Patent Publication No. 2015/0031831, which description is hereby incorporated by reference. The method broadly includes obtaining X-Ray Diffraction patterns for the polymer sample, then calculating a transmission coefficient for each sample (by dividing (i) initial image of sample $I_t$ by initial image of empty sample holder $I_0$, at 25° C.), and calculating % crystallinity by comparing the scattering intensity of crystalline peaks to the total scattering intensity. For purposes herein, unless otherwise noted, measurements taken at 25° C. should be used to determine % crystallinity of the copolymer composition and/or its fractions.

According to certain embodiments, each of the first and second fractions exhibit 0% crystallinity at 25° C. as determined by XRD analysis (and, accordingly, the copolymer composition also exhibits 0% crystallinity). It can be expected that the higher-ethylene fraction would tend to exhibit higher crystallinity (if any) than the lower-ethylene fraction; furthermore, at lower test temperatures, XRD analysis may indicate greater degree of crystallinity. Accordingly, in some embodiments, the copolymer composition may exhibit less than 10% crystallinity, such as within the range from 1% to 5% crystallinity, as determined by XRD analysis at 5° C. In such embodiments, the first fraction (e.g., higher-ethylene fraction) may exhibit less than 15% crystallinity (such as within the range from 4% to 14%, or 4% to 10%).

Polymerization Reactions

Any suitable polymerization process for making bimodal polymer compositions in accordance with the foregoing descriptions may be utilized. Each discrete ethylene-α-olefin copolymer (e.g., the copolymer composition in single-reaction zone embodiments, or each of the first and second ethylene-α-olefin copolymer components in some multi-reaction zone embodiments) can be polymerized in a single, well stirred tank reactor in solution. Suitable solvents include typical hydrocarbon solvents. Preferably, the solvent is a hydrocarbon solvent such as mixed hexanes (isohexanes, cyclohexanes, and/or hexanes), or, more preferably, isohexane. However, any other suitable hydrocarbon solvent(s) for solution polymerization processes may be used (particularly any other hydrocarbon solvent with similar boiling point, e.g., within 25° C., preferably within 20° C., more preferably within 15° C., of isohexane). The viscosity of the solution during polymerization can be less than 10000 cPs, or less than 7000 cPs, and preferably less than 500 cPs.

Suitable reactors according to some embodiments include liquid filled, continuous flow, stirred tank reactors providing full back mixing for random copolymer production. Solvent, monomers, and catalyst(s) are fed to the reaction zone. When two or more reaction zones are utilized, solvent, monomers, and/or catalyst(s) are fed to the first reaction zone or to one or more additional reaction zones. A single reaction zone may comprise multiple reactors operating at substantially similar conditions; or, in some embodiments, multiple reaction zones may be used. For instance, series or parallel reaction zone configurations may be utilized. In series reaction, the effluent of the first reactor (containing solvent, polymer product, and potentially also unreacted monomers and/or unspent catalyst) may be fed to the second series reactor. Additional monomer, solvent, and/or catalyst may further be fed to the second series reactor.

Furthermore, hydrogen may be added to the reactor (or, to the first and/or second series or parallel reaction zones in multi-reaction zone configuration), in accordance with the description in paragraphs [0065]-[0069] of WIPO Publication No. WO 2013/115912, which description is hereby incorporated by reference. According to some embodiments, hydrogen may not be fed to the first reactor (i.e., such that the feed to reactor 1 comprises 0 wt % hydrogen). In embodiments where hydrogen is fed to the first reactor, it may be fed to the first reactor in an amount within the range from 0.1, 0.15, 0.2, 0.25, 0.3, 0.4, 0.5, 0.6 wt % to 0.2, 0.3, 0.4, 0.5, 0.7, 0.8, 0.9, 1.0, 1.1, 1.2, 1.3, 1.4, or 1.5 wt %, the weight percentages being based on the total mass of monomer(s) (e.g., ethylene, propylene, and/or other suitable α-olefins), hydrogen, and solvent fed to the first reactor (and with ranges from any low end to any high end contemplated in various embodiments). Likewise, hydrogen may or may not be fed to the second reactor; where hydrogen is fed to the second reactor, it is fed in amounts within the range from 0.05, 0.06, 0.07, 0.08, 0.09, 0.1, or 0.15 wt % to 0.1, 0.2, 0.3, 0.4, or 0.5 wt %, the weight percentages being based on the total mass of monomer(s), hydrogen, and solvent fed to the second reactor (and with ranges from any low end to any high end contemplated in various embodiments).

In yet other embodiments, slurry phase or bulk phase polymerization may be utilized in any or all given reaction zones, instead of solution phase polymerization.

Preferred catalysts include metallocene catalysts. Any metallocene catalyst suitable for producing ethylene-α-olefin copolymers as described herein may be used (particularly preferred catalysts according to some embodiments are described in more detail herein below).

Temperature of each polymerization reaction zone may be controlled by any suitable means, for instance, via reactor cooling jackets, cooling coils, use of auto-refrigeration pre-chilled feeds, and/or combinations thereof to absorb the heat of the exothermic polymerization reaction. Auto-refrigerated reactor cooling requires the presence of a vapor phase in the reactor. According to some embodiments, adiabatic reactors with pre-chilled feeds are preferred, in which the polymerization exotherm is absorbed by permitting a temperature rise of the polymerizing liquid.

Reactor temperature and/or hydrogen feed rates may be used to control the molecular weight (e.g., $M_w$, $M_n$, and other related properties including MFR) of the polymer products produced in a given reaction zone. For instance, hydrogen may act as a chain transfer agent, stopping incorporation of monomers into a growing polymer chain (e.g., such that greater hydrogen feed may correlate with smaller polymer chains, i.e., higher MFR). Temperature can deactivate the catalyst. Such methods for controlling MFR are described in more detail below.

In general, though, polymerization temperatures may suitably be within the range from any one of 0° C., 80° C., or 100° C. to any one of 150° C., 180° C., or 200° C. in a given polymerization reaction zone, with temperatures in certain embodiments falling within the range from 100° C. to 150° C. or from 110° C. to 150° C. When using one or more additional polymerization reaction zones, the additional reaction zone temperature will vary from about 40° C. to about 200° C., with about 50° C. to about 150° C. preferred, and about 100° C. to about 150° C. more preferred. Further, the difference in temperature between two reaction zones, particularly in series reaction embodiments, may be less than 40° C., preferably less than 30° C., 20° C., 10° C., or even less than 5° C. or 3° C. Further, in series polymerization reactions, temperature is preferably selected so as not to deactivate the catalyst in the first reaction zone to such levels that catalyst activity in the second reaction zone is too low to produce adequate amounts of second copolymer component; alternatively or in addition, additional catalyst may be fed to the second reaction zone to sustain adequate levels of polymerization to achieve desired amounts of second copolymer component produced in the second reaction zone.

Reaction pressure is determined by the details of the catalyst system. In general, a reactor, whether a single reactor or each of a series of reactors, operates at a reactor pressure of less than 2500 pounds per square inch (psi) (17.23 MPa), or less than 2200 psi (15.16 MPa) or less than 2000 psi (13.78 MPa). Preferably, reactor pressure is from about atmospheric pressure to about 2000 psi (13.78 MPa), or from about 200 psi (1.38 MPa) to about 2000 psi (13.78 MPa), or from about 300 psi (2.07 MPa) to about 1800 psi (12.40 MPa). Ranges from any of the recited lower limits to any of the recited upper limits are contemplated and within the scope of the present description.

Particular reactor configurations and operations suitable for use in the processes described herein are described in detail in U.S. Pat. No. 6,319,998 and U.S. Provisional Patent Application having Ser. No. 60/243,192, filed Oct. 25, 2000, which are incorporated by reference herein. Branching can be introduced by the choice of polymerization catalysts or process.

Catalysts and Activators

As noted, any metallocene catalyst suitable for producing ethylene-α-olefin copolymers as described herein may be used. As the ordinarily skilled artisan will understand, metallocene catalysts exist in a precursor or pre-catalyst form (as described in this section), in which the catalyst precursor is a generally neutral complex, but when activated with a suitable co-catalyst (also referred to as an activator) yields an active metallocene catalyst which refers generally to an organometallic complex with a vacant coordination site that can coordinate, insert, and polymerize olefins.

References to a "catalyst" shall mean the catalyst in pre-activated form where context makes this clear (e.g., by reference to desired catalyst structures as described in this section). On the other hand, in discussions of a "catalyst" in processes herein (e.g., feeding a catalyst to a polymerization reaction zone), is to be understood that such catalyst will require activation in order to carry out polymerizations. So, references to feeding a catalyst to a polymerization reaction zone should be understood to mean that (i) the catalyst is pre-activated, and therefore fed in its activated zone; (ii) the catalyst is fed together with activator for in-situ activation; and/or (iii) the catalyst and activator are fed separately to the polymerization reaction zone, providing an alternative method for in-situ activation. Activation of metallocene catalysts is well known and well-documented. See, for instance, U.S. Pat. Nos. 5,324,800; 5,198,401; 5,278,119; 5,387,568; 5,120,867; 5,017,714; 4,871,705; 4,542,199; 4,752,597; 5,132,262; 5,391,629; 5,243,001; 5,278,264; 5,296,434; 5,334,677; 5,416,228; 5,449,651; and 5,304,614.

Particularly preferred catalysts include the mono-cyclopentadienyl (mono-Cp) and/or bis-Cp catalysts (including symmetrical and asymmetrical bis-Cp catalysts) described in paragraphs [0046]-[0056] of WIPO Publication No. WO 2013/115912, which description is hereby incorporated by reference. As noted therein (e.g., in paragraph [0046], the Cp ring ligands of such catalysts may include fused substitutions, such that the Cp ring ligand is more particularly another form of saturated or unsaturated ring system, such as a tetrahydroindenyl, indenyl, or fluorenyl ring system. Indeed, in some embodiments, suitable catalysts include bridged bisindenyl metallocene catalysts as described in paragraphs [0053]-[0056] of WO 2013/115912.

Suitable activators include the non-coordinating anions described in paragraphs [0057]-[0060] of WO 2013/115912, and/or in paragraphs [0110]-[0133] of US Patent Publication No. 2015/0025209, which descriptions are also incorporated herein by reference. Non-ionic activators as described in paragraphs [0061]-[0062] of WO 2013/115912 may also be suitable, and such description is additionally incorporated by reference herein. Particularly useful activators in some embodiments include non-coordinating anion (NCA) activators, such as those in paragraph [0124] of US 2015/0025209, and also those in columns 7 and 20-21 in U.S. Pat. No. 8,658,556, which description is incorporated by reference. Particular examples of suitable NCA activators include: N,N-dimethylanilinium tetrakis(pentafluorophenyl) borate, N,N-dimethylanilinium tetrakis(perfluoronaphthyl) borate, N,N-dimethylanilinium tetrakis (perfluorobiphenyl) borate, triphenylcarbenium tetrakis(perfluoronaphthyl) borate, bis($C_4$-$C_{20}$alkyl)methylammonium tetrakis (perfluoronaphthyl)borate, $Me_3NH$ tetrakis(pentafluorophenyl)borate, $Me_3NH$ tetrakis(heptafluoro-2-naphthyl)borate, and bis(hydrogenated tallowalkyl)methylammonium tetrakis(pentafluorophenyl)borate.

Tuning Polymer Properties in Series or Parallel Polymerizations

In particular embodiments, preferred processes include series or parallel polymerizations using two polymerization reaction zones (each of which may constitute a single polymerization reactor, multiple reactors receiving feed and working in parallel under approximately identical temperature, pressure, and other reaction conditions, or a discrete polymerization zone within a single reactor operated so as to enable distinct areas of polymerization reactions). The copolymer compositions produced in accordance with series reaction polymerization embodiments may be referred to as series reactor blends; copolymer compositions produced by parallel polymerization may be blended post-polymerization, and are therefore referred to as post-reaction, post-reactor, or post-polymerization blends.

Further, as noted previously, preferred polymerization reactions utilize solution polymerization, in particular solution metallocene polymerization (e.g., solution polymerization reactions carried out using metallocene catalysts, and in particular one or more metallocene catalysts in accordance with the above description). In such embodiments, solvent is preferably removed from the polymerization effluent(s) (e.g., first effluent and/or second effluent in series or parallel multi-reactor configurations) so as to obtain a solid polymer product. Suitable devolatilization processes to accomplish this are well-known, and any suitable devolatilization process may be applied to the solution polymerization processes described herein.

Processes for forming a reactor blend bimodal copolymer composition according to particular embodiments therefore comprise feeding to a first polymerization reaction zone (i) a plurality of monomers comprising ethylene and a first $C_3$-$C_{20}$ α-olefin comonomer, (ii) a solvent, (iii) a first metallocene catalyst, and (iv) optionally, hydrogen. A first polymer reaction product (e.g., ethylene-α-olefin copolymer in accordance with the foregoing description of the first ethylene-α-olefin copolymer component) is formed in the first polymerization reaction zone, and a first polymerization reaction effluent (comprising at least a portion of the first polymer reaction product and at least a portion of the solvent) is withdrawn from the first polymerization reaction zone. In some embodiments, this effluent may further comprise some unreacted monomer and/or comonomer from the first reaction zone.

In series blend embodiments, the effluent is then fed to a second polymerization reaction zone, along with an additional plurality of monomers comprising ethylene and/or a second $C_3$-$C_{20}$ α-olefin comonomer. Optionally, one or more of the following may also be fed to the second polymerization reaction zone: additional solvent, additional hydrogen, and a second metallocene catalyst. In post-polymerization (parallel reactor) blend embodiments, the first effluent is combined with a second polymerization effluent formed in the second polymerization reaction zone; additional monomer, comonomer, catalyst, solvent, and, optionally, hydrogen, are fed directly to the second polymerization reaction zone.

In the second polymerization reaction zone, a second polymer reaction product is formed (which may be, e.g., an ethylene-α-olefin copolymer in accordance with the foregoing description of the second ethylene-α-olefin copolymer component), and a second effluent comprising the second product is withdrawn from the second reaction zone. In series reactor configurations, the second effluent is an intimate blend of (i) unreacted first polymer reaction product provided to the second reaction zone and (ii) second polymer reaction product formed in the second reaction zone. In parallel configurations, the second effluent, comprising the second polymer reaction product, is then blended (melt-mixed or otherwise physically blended) with the first polymerization effluent (comprising the first polymer reaction product) to form the intimately blended bimodal copolymer composition.

In such processes, the second metallocene catalyst fed to the second polymerization reaction zone may be the same as or different from the first metallocene catalyst, though it is preferably the same—so, processes according to such embodiments may be characterized as including feeding additional metallocene catalyst to the second polymerization reaction zone. Of course, some series reactor embodiments utilize catalyst feed only to the first polymerization reaction zone, relying on catalyst present in the first effluent fed to the second polymerization reaction zone to continue polymerizations in the second reaction zone; however, other series reactor embodiments also utilize catalyst feed to the second reaction zone. Further, as previously discussed, feeding metallocene catalyst to a polymerization reaction zone includes either feeding catalyst in its activated form, or co-feeding catalyst with activator so that the catalyst is activated in the feed and/or in situ in a given polymerization reaction zone.

As also previously discussed, hydrogen may be fed to one or both of the polymerization reaction zones. Solvent may be fed to only the first or to both reaction zones.

Solvent identities, reactor operating conditions, metallocene catalyst and activator compositions, etc. are all in accordance with the previous general description of processes according to various embodiments.

In addition, some embodiments provide polymerization processes suitable for controlling the production of viscosity modifying polymers in a manner that modifies the TE and/or SSI of the polymers (when used as viscosity modifiers), while advantageously allowing for one to maintain other key properties roughly constant. Such control methods further allow for ready on-line control to shift TE and/or SSI of a polymer composition during a given commercial production campaign, even though TE and/or SSI measurement normally requires formulating a lubricating oil composition with the polymer, and measuring the formulated lubricant.

Processes in accordance with such embodiments may include forming an initial copolymer composition at a first time, subsequently adjusting polymerization conditions so as to obtain an adjusted copolymer composition having one or more of the following properties changed as compared to the initial copolymer composition: (1) MFR of the copolymer composition; (2) cMFRR of the copolymer composition; (3) and $MFR_A/MFR_B$. The ethylene content of the adjusted copolymer composition is virtually the same (e.g., within 5 wt % or less, preferably 2 wt % or less) of the ethylene content of the initial copolymer composition. Lubricating oil compositions employing the adjusted copolymer composition as a viscosity modifier may exhibit a different TE and/or SSI than un-adjusted lubricating oil compositions comprising the initial copolymer composition, but which are otherwise identical to the adjusted lubricating oil composition. Such processes could be employed advantageously in shifting product campaigns between similar polymer products, particularly where differing SSI and/or TE is necessary or desired. The above-noted properties (1)-(3), as well as (4) ethylene wt % of the polymer composition, can be used to predict the TE and SSI that the polymer would impart upon a lubricating oil composition, and therefore, controlling to such properties permits control to desired TE and/or SSI. Therefore, certain embodiments include controlling a polymerization reaction based at least in part upon measured (1) MFR, (2) cMFRR, and/or (3) IFMFRR of a copolymer composition produced by the process, so as to ensure the copolymer composition will meet target TE and/or SSI when employed in a lubricating oil composition. Such control processes advantageously eliminate the need to separately test a copolymer composition in lubricating oils, instead providing a useful control mechanism that can be implemented on-line and on-site.

For example, in some embodiments, processes may be employed, e.g., in a polymerization production campaign in order to generate at least two different bimodal ethylene copolymer compositions, each having the same (within ±5 wt %, preferably within ±2 wt %) ethylene content, but exhibiting different SSI when employed in a lubricating oil composition. For instance, processes according to such embodiments may include: (a) using a polymerization reaction system to produce, at a first time, a first bimodal ethylene copolymer composition comprising a first fraction A and a second fraction B, the first bimodal ethylene copolymer composition having: (i) MFR equal to $MFR_1$; (ii) cMFRR equal to $cMFRR_1$; (iii) $MFR_A/MFR_B$ equal to $(MFR_A/MFR_B)_1$; and (iv) ethylene content of $E_1$ wt %; (b) determining target TE and/or SSI performance for a second ethylene copolymer composition; (c) based at least in part upon the determined target TE and/or SSI, determining an adjusted MFR, adjusted cMFRR, and adjusted $MFR_A/MFR_B$ such that one or more of the adjusted MFR, cMFRR, and $MFR_A/MFR_B$ are different from $MFR_1$, $cMFRR_1$, and/or $(MFR_A/MFR_B)_1$, respectively; and (d) using the polymerization reaction system to produce, at a second time after the first time, a second bimodal ethylene copolymer composition comprising a first fraction A' and a second fraction B', wherein the second ethylene copolymer composition has MFR, cMFRR, and $MFR_A/MFR_B$ equal to the adjusted MFR, adjusted cMFRR, and adjusted $MFR_A/MFR_B$, respectively.

Determining target MFR (and/or other target values) of the copolymer composition may comprise determining corresponding target values for each (or both) fractions. For instance, determining target MFR may comprise determining target $MFR_A$ for the first fraction, target $MFR_B$ for the second fraction, or both. Thus, the adjusted first fraction may have adjusted $MFR_A$ equal (or within 10%, 5%, or 1% of, see below) target $MFR_A$; adjusted second fraction may have adjusted $MFR_B$ equal (or within 10%, 5%, or 1% of) target $MFR_B$; or both.

$MFR_A$ of the first fraction (A) is a convenient variable to use to implement such control strategies according to some embodiments. This affects both IFMFRR and cMFRR, and may be controlled by known techniques, including adjusting one or more polymerization reaction conditions of a polymerization reaction system. The ordinarily skilled artisan will recognize that a polymerization reaction system may include, e.g., a series or parallel reaction configuration as described elsewhere herein (e.g., comprising first and second polymerization reaction zones set up in a series or parallel configuration). References to adjusting polymerization reaction conditions in a "polymerization reaction system" include adjusting conditions in one or more polymerization reaction zones within such a system (e.g., adjusting conditions in a first reaction zone for producing first fraction; adjusting conditions in a second reaction zone for producing second fraction; or both).

For instance, hydrogen (and or additional hydrogen) may be supplied to a polymerization reaction system in which the first and/or second fractions are being formed (i.e. hydrogen feed rate to the polymerization reaction system may be adjusted). The polymerization reaction system may comprise one or more polymerization reaction zones; for instance, in series reaction systems, the reaction system may comprise first and second polymerization reaction zones, and hydrogen may be supplied to the first (to adjust first fraction MFR), to the second (to adjust second fraction MFR), or both. Higher hydrogen flow rates relative to monomer and catalyst flow rates tend to lead to shorter polymer chains (higher MFR) due to hydrogen's known effect of stopping polymer chain growth in metallocene polymerizations. As another example, catalyst feed rate and/or monomer feed rates may be adjusted in the polymerization reaction system. Similarly, polymerization temperature may be adjusted. Adjusting MFR (i.e., polymer chain length) in a polymerization reaction process is a well-known technique, and the ordinarily skilled artisan with the benefit of this disclosure will readily appreciate any of numerous ways in which MFR of either or both polymer fractions can be adjusted.

Polysplit (the relative amount of first fraction as a portion of the overall copolymer composition) may also be readily controlled, and will affect all desired properties of the copolymer composition (MFR, cMFRR, and IFMFRR). It, again, is readily controlled by known polymerization techniques. For instance, in series reactor configuration, relative flow rate from a first series reactor to a second may be increased to increase polysplit, or decreased to decrease polysplit. Similarly, the polysplit of copolymer compositions made by parallel polymerization processes (e.g., with the first and second fractions produced in parallel reactors and combined via post-reactor techniques such as melt mixing) may readily be controlled by simply adjusting the relative amount of first fraction combined with the second fraction. Catalyst feed rate and polymerization reaction temperature and/or pressure are further conditions that may be used to adjust the MFR, cMFRR, and/or IFMFRR properties, again in accordance with known polymerization techniques.

In particular embodiments, the adjustment preferably achieves a target inter-component MFR ratio in accordance with the previously-describe ranges of $MFR_A/MFR_B$ (e.g., high, low, and/or intermediate) for polymer compositions of some embodiments, within 10%, 5%, or even 1% of the target (e.g., for a target MFR ratio of 1.2, a 10% margin of error for the adjustment would include MFR ratios within ±0.12 of the 1.2 target, so an adjusted inter-component MFR ratio would be within the range from 1.08 to 1.32). In some embodiments, it is preferred that the adjustment achieve an inter-component MFR ratio closer to 1 than the initial inter-component MFR ratio; in yet other embodiments, however, the desired inter-component MFR ratio may be any desired value based, e.g., upon desired TE and/or SSI performance.

Polymerization processes suitable for such adjustment may include, for instance, forming an initial multimodal copolymer composition (preferably a bimodal ethylene copolymer composition) by feeding (1) a plurality of monomers (preferably comprising ethylene and one or more $C_3$ to $C_{20}$ α-olefin co-monomers), (2) solvent, (3) catalyst, and, optionally, (4) hydrogen to one or more polymerization reaction zones. With multiple polymerization reaction zones, one or more of such feeds may be provided to each polymerization reaction zone, or just to one, or any combination thereof. Polymerization processes suitable for adjustment may include processes in accordance with the series or parallel polymerizations described above.

The effects of this adjustment include a modification of TE and/or SSI of the copolymer composition when it is employed in a lubricating oil composition. The adjusted copolymer composition otherwise has constant ethylene content, and/or relative amounts of each of two copolymer component fractions, as compared to the first copolymer composition.

As noted, series or parallel polymerization processes are particularly advantageous for such adjustment procedures, due to the control afforded over each polymerization reaction zone in the series or parallel reaction, and therefore control over the MFRs of the polymer fractions in the produced polymer composition.

For instance, a polymerization process according to some more particular embodiments may include:

(a) feeding to a first polymerization reaction zone: (i) a first ethylene monomer at a first monomer feed rate; (ii) a first $C_3$-$C_{20}$ α-olefin comonomer at a first comonomer feed rate; (iii) a first metallocene catalyst at a first catalyst feed rate; and (iv) optionally, first hydrogen at a first hydrogen feed rate, such that an initial first ethylene-α-olefin copolymer product (A1) having MFR (ASTM D1238, at 230° C. and 2.16 kg) of $MFR_{A1}$ is formed in the first polymerization reaction zone;

(b) feeding to a second polymerization reaction zone at least: (i) a second ethylene monomer at a second monomer feed rate; (ii) a second $C_3$-$C_{20}$ α-olefin comonomer at a second comonomer feed rate; (iii) optionally, a second metallocene catalyst at a second catalyst feed rate; and (iv) optionally, second hydrogen at a second hydrogen feed rate, such that an initial second ethylene-α-olefin copolymer product (B1) having MFR of $MFR_{B1}$ is formed in the second polymerization reaction zone;

(c) forming an initial ethylene copolymer composition comprising a blend (e.g., either an intimate series reactor blend or a post-polymerization blend) of the initial first ethylene-α-olefin copolymer product (A1) and the initial second ethylene-α-olefin copolymer product (B1), wherein the initial ethylene copolymer composition has (1) MFR of $MFR_1$, (2) cMFRR of $CMFRR_1$, and (3) IFMFRR of $MFR_{A1}/MFR_{B1}$;

(d) adjusting one or more polymerization reaction conditions (e.g., one or more of (a-i) the first monomer feed rate; (a-ii) the first comonomer feed rate; (a-iii) the first catalyst feed rate; (a-iv) the first hydrogen feed rate; (b-i) the second monomer feed rate; (b-ii) the second comonomer feed rate; (b-iii) the second catalyst feed rate; and (b-iv) the second hydrogen feed rate) so as to form an adjusted first ethylene-α-olefin copolymer product (A2) having MFR of $MFR_{A2}$ and (ii) an adjusted second ethylene-α-olefin copolymer product (B2) having MFR of $MFR_{B2}$; and (e) forming an adjusted ethylene copolymer composition comprising a blend of the adjusted first ethylene-α-olefin copolymer product (A2) and the adjusted second ethylene-α-olefin copolymer product (B2), wherein the adjusted ethylene copolymer composition has MFR of $MFR_2$, cMFRR of $cMFRR_2$, and IFMFRR of $MFR_{A2}/MFR_{B2}$, such that one or more of the following conditions is satisfied:

(e-i) $MFR_2$ is different from $MFR_1$;

(e-ii) $cMFRR_2$ is different from $cMFRR_1$; and (e-iii) $MFR_{A2}/MFR_{B2}$ is different from $MFR_{A1}/MFR_{B1}$.

In embodiments wherein the condition (e-iii) is satisfied (i.e., where $MFR_{A2}/MFR_{B2}$ is different from $MFR_{A1}/MFR_{B1}$), both of the adjusted first and adjusted second ethylene-α-olefin copolymer products may have different MFRs than the initial (e.g., $MFR_{A2}$ may be different from $MFR_{A1}$ and $MFR_{B2}$ may be different from $MFR_{B1}$); or, only one of the two components' MFRs may change (e.g., $MFR_{A1}$ may equal $MFR_{A2}$; or $MFR_{B1}$ may equal $MFR_{B2}$), so long as the ratio $MFR_A/MFR_B$ changes from the initial to the adjusted copolymer compositions.

In series polymerization processes, (c) forming the initial ethylene copolymer composition may be accomplished by feeding at least a portion of the initial first ethylene-α-olefin copolymer product from the first polymerization reaction zone to the second polymerization reaction zone, such that the effluent of the second polymerization reaction zone comprises the initial ethylene copolymer composition as an intimate blend comprising unreacted (in the second reaction zone) initial first ethylene-α-olefin copolymer product (A) and the initial second ethylene-α-olefin copolymer product (B) formed in the second polymerization reaction zone. The adjusted ethylene copolymer composition is formed in a similar manner, comprising unreacted adjusted first ethylene-α-olefin copolymer product and the adjusted second ethylene-α-olefin copolymer product formed in the second polymerization reaction zone.

In parallel polymerization reaction processes, the initial ethylene copolymer composition may be formed as a post-reactor or post-polymerization blend, e.g., by mixing the initial first and second ethylene-α-olefin copolymer products (either in solution, or after devolatilization, e.g., by melt-mixing processes or the like). The adjusted copolymer composition is similarly formed by mixing the adjusted first and second ethylene-α-olefin copolymer products.

Furthermore, in some embodiments, target properties (MFR, cMFRR, IFMFRR) for the adjusted copolymer composition are determined in advance of the adjustment. These target properties may be determined based at least in part upon a desired or target TE and/or SSI (preferably both) performance of the bimodal copolymer composition (when used as a rheology modifier). Processes according to some such embodiments therefore further comprise (c-1) determining a target MFR, target cMFRR, and/or target IFMFRR; and the adjusting (d) is carried out so that the MFR, cMFRR, and/or IFMFRR are changed to meet (preferably within 10%, 5%, or 1%, more preferably equaling) the determined target inter-component MFR, target cMFRR, and/or target IFMFRR.

Preferably, the ethylene contents (wt %) of each of the adjusted first and second ethylene-α-olefin copolymer products are constant as compared to the ethylene contents of each of the initial first and second ethylene-α-olefin copolymer products, respectively (and thus, the overall ethylene content of the initial vs. adjusted ethylene copolymer composition remains constant). As used in this context, "constant" means that the ethylene wt % changes by less than 5%, preferably less than 3%, more preferably less than 1% from the initial to the adjusted ethylene copolymer compositions (and/or in either fraction). Such percentages are determined by dividing the larger ethylene content (either initial or adjusted) by the smaller ethylene content (the other of initial or adjusted), subtracting 1, and converting to a percentage (e.g., such that a result of 1.04 means a 4% change). In certain embodiments, the polysplit (relative amount of first and second ethylene-α-olefin copolymer products of the copolymer composition) remains constant as compared to the initial ethylene copolymer composition, such that the relative amount of adjusted first ethylene-α-olefin copolymer product is within 5%, preferably 3%, more preferably 1%, of the initial first ethylene-α-olefin copolymer (such amount being a wt % based on total weight of the entire copolymer composition).

These adjusting processes are suitable for adjusting TE and/or SSI performance of bimodal ethylene copolymer compositions with a wide range of (i) overall ethylene contents, (ii) relative amounts of each copolymer fraction, and (iii) ethylene contents of each fraction, so long as such properties (i)-(iii) remain constant through the adjusting process. For instance, initial and adjusted overall ethylene contents of some embodiments may be within the range from 1 to 99 wt %, such as 20 to 80, 30 to 70, or 40 to 60 wt %, with ranges from any of the foregoing lows to any of the foregoing high ends also contemplated in various embodiments. Likewise, initial and adjusted relative amount of first copolymer fraction (e.g., first ethylene-α-olefin component) and second copolymer fraction (e.g., second ethylene-α-olefin component) may each independently be within the range from 5 to 95 wt %, such as 10 to 90, 20 to 80, 30 to 70, 40 to 60, 40 to 50, 50 to 60, or 45 to 55 wt %, with ranges from any of the foregoing low ends to any of the foregoing low ends also contemplated. In particular embodiments, the initial and adjusted copolymer compositions comprise more of the second copolymer fraction than the first.

Further, the processes are suitable for adjusting bimodal copolymer compositions with a wide range of initial inter-component MFR ratios (and components or fractions having MFR within a wide range). For instance, initial inter-component MFR ratios may be within the range from 0.01 to 100. And, MFR of each of the first and second ethylene copolymer fractions may independently be within the range from 0.3 to 50, such as 0.5 to 40, 1.0 to 30, 5.0 to 20, or 5.0 to 10 g/10 min (ASTM D1238, condition L (230° C./2.16 kg)), with ranges from any of the foregoing low ends to any of the foregoing high ends also contemplated in various embodiments.

The adjusted inter-component MFR ratios may be within a wide range, depending upon the desired TE imparted to lubricating oil compositions by viscosity modifiers comprising the bimodal copolymer composition, and/or the need to minimize tendency toward gelation and/or filter plugging in the intended end-use application of such a lubricating oil composition. For instance, according to some embodiments in which it is desired to maximize TE, adjusted inter-component MFR ratio or adjusted IMFRR ($MFR_A/MFR_B$) may be low or intermediate, such as within the range from a low end of any one of 0.2 to 6 or 0.5 to 3, or 1.5 to 6, such as 1.75 to 5.0, or 1.5 to 3.0, or 0.5 to 1.5, with ranges from any aforementioned lower limit to any aforementioned upper limit also contemplated in various embodiments. Such inter-component MFR ratios are calculated based upon the individual fractions' MFRs determined as g/10 min (ASTM D1238, condition L (230° C./2.16 kg)), and/or MFRs as calculated (e.g., in the case of series reactor blends per previous description). In certain of these embodiments, the adjusted inter-component MFR ratio is closer to 1.0 than the initial inter-component MFR ratio. However, as noted, the target MFR ratio is not necessarily 1.0 according to some embodiments—it may instead depend upon the desired TE performance of the copolymer composition. For instance, adjusted $MFR_A/MFR_B$ of such embodiments may be within the range from 0.5 to 1.5 g/10 min. Further, such adjustment may be achieved by, e.g., adjusting $MFR_B$ (e.g., from initial range from 1.8 to 2.5 g/10 min, to adjusted $MFR_B$ within the range from 1.3 to 1.7 g/10 min).

In embodiments in which it is desired to avoid gelation and/or filter plugging (even at the potential expense of reduced TE) by having increased $MFR_A$ (e.g., 10.0 g/10 min or greater), then the adjusted IMFRR ($MFR_A/MFR_B$) may instead be 10.0 or greater, such as within the range from a low of 10, 12, 15, 17, or 20 to a high of 25, 30, 35, 40, 45, 50, 55, 60, 65, 70, or 75, with ranges from any of the foregoing lows to any of the foregoing highs contemplated. In some of these embodiments, such adjustment may be achieved by, e.g., decreasing $MFR_B$ from (i) within the range from 1 to 3 g/10 min to (ii) within the range from 0.2 to 0.8 g/10 min (e.g., such that initial $MFR_B$ is within the range of 1 to 3 g/10 min; and adjusted $MFR_B$ is within the range from 0.2 to 0.8 g/10 min). Further, in some of these embodiments, overall MFR may be adjusted from the range from 3 to 7 g/10 min to being within the range from 1 to 2 g/10 min.

The MFR of initial and adjusted copolymers may each be within the range from 0.5 to 30 g/10 min (ASTM D1238, 230° C./2.16 kg), such as within the range from a low of any one of 0.5, 1.0, 1.5, 2.0, 2.5, and 3.0 to a high of any one of 2.5, 3.0, 3.5, 4.5, 5, 6, 7, 8, 9, 10, 15, 20, 25, and 30 g/10 min, provided the high end of the range is greater than the low end of the range.

Initial cMFRR and adjusted cMFRR can each range from a low end of any one of 15, 20, 25, 30, and 35 to a high end of any one of 25, 30, 35, 40, 45, 50, 55, 60, and 65, provided the high end of the range is greater than the low end.

In particular embodiments, the adjusted copolymer composition (and each of the adjusted first ethylene-α-olefin product and adjusted second ethylene-α-olefin product) exhibit MFR, cMFRR, IFMFRR, ethylene content, and, optionally, any other properties, in accordance with the copolymer compositions described above in the "Copolymer Compositions" and/or "Ethylene-α-olefin Copolymer Components" sections. Thus, in such embodiments, the adjusted $MFR_A$ and $MFR_B$, as well as the adjusted inter-component MFR ratio ($MFR_A/MFR_B$) after the adjusting (d), are in line with those previously described for first and second ethylene-α-olefin copolymer components; adjusted cMFRR is in line with those described previously for copolymer compositions of various embodiments; etc.

Lubricating Oil

As previously noted, one suitable application for the bimodal copolymer compositions of various embodiments is as a viscosity or rheology modifier in a lubricating oil composition. Lubricating oil compositions containing viscosity modifiers, and other suitable ingredients in such oil compositions, are described in paragraphs [0086]-[00102] of WIPO Publication No. WO 2013/115912, which description is incorporated by reference herein. Exemplary lubricating oil compositions per that description include a blend of the bimodal copolymer composition with a base oil or basestock, which may be characterized as a polyalphaolefin (PAO) having viscosity less than a PAO-20 or PAO-30 oil, as described in paragraph [0087] of WO 2013/115912. Alternatively, the basestock may be described as any American Petroleum Institute (API) Group I, II, III, IV, or V oil, or any combination thereof. Suitable oils include both hydrocarbon oils derived from petroleum and synthetic lubricating oils. These and other basestocks are well known in the art, and the copolymer compositions of the present disclosure may be blended with any such basestock suitable for lubricating applications. The base oil can have kinematic viscosity at 100° C., as measured by ASTM D445, in a range of 1.5 to 100 cSt.

The lubricating oil may comprise at least 50 wt % of a base oil, based on the weight of the lubricating oil composition. For example, the base oil may be present in the lubricating oil composition in an amount of at least 60% (e.g., at least 70 wt %, at least 80 wt %, at least 90 wt %, at least 95 wt %, at least 96 wt %, at least 97 wt %, or at least 98 wt %), based on the weight of the lubricating oil composition.

Suitable base oils include those conventionally employed as crankcase lubricating oils for spark-ignited and compression-ignited internal combustion engines, such as automobile and truck engines, marine and railroad diesel engines, and the like. Advantageous results are also achieved by employing the bimodal copolymers in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation of the present bimodal copolymers.

Furthermore, suitable lubricating oil compositions including the bimodal copolymer composition may include any of the various other components known to be suitable for inclusion in lubricating oil compositions, such as pour point depressants, antiwear agents, antioxidants, other viscosity-index improvers, dispersants, corrosion inhibitors, anti-foaming agents, detergents, rust inhibitors, friction modifiers, and the like described in paragraphs [0092]-[00102] of WO 2013/115912. When lubricating oil compositions contain one or more of the components discussed above, the additive(s) are blended into the composition in an amount sufficient for it to perform its intended function. Typical amounts of such additives useful in the present disclosure are shown in Table A below.

TABLE A

Typical Amounts of Various Lubricating Oil Components

| Compound | Approximate wt % (useful) | Approximate wt % (preferred) |
|---|---|---|
| Detergents | 0.01-8 | 0.01-4 |
| Dispersants | 0.1-20 | 0.1-8 |
| Antiwear agents | 0.01-6 | 0.01-4 |
| Friction Modifiers | 0.01-15 | 0.01-5 |
| Antioxidants | 0.01-5 | 0.1-2 |
| Pour Point Depressants | 0.01-5 | 0.1-1.5 |
| Anti-foam Agents | 0.001-1 | 0-0.2 |
| Corrosion Inhibitors | 0-5 | 0-1.5 |
| Other Viscosity Improvers (solid polymer basis) | 0.25-10 | 0.25-5 |

Detergents and metal rust inhibitors include the metal salts of sulfonic acids, alkylphenols, sulfurized alkylphenols, alkyl salicylates, naphthenates and other oil soluble mono- and dicarboxylic acids. Highly basic (i.e., overbased) metal salts, such as highly basic alkaline earth metal sulfonates (especially Ca and Mg salts) are frequently used as detergents.

Dispersants maintain oil insolubles, resulting from oxidation during use, in suspension in the fluid, thus preventing sludge flocculation and precipitation or deposition on metal parts. Suitable dispersants include high molecular weight N-substituted alkenyl succinimides, the reaction product of oil-soluble polyisobutylene succinic anhydride with ethylene amines such as tetraethylene pentamine and borated salts thereof. High molecular weight esters (resulting from the esterification of olefin substituted succinic acids with mono or polyhydric aliphatic alcohols) or Mannich bases from high molecular weight alkylated phenols (resulting from the condensation of a high molecular weight alkyl-substituted phenol, an alkylene polyamine and an aldehyde such as formaldehyde) are also useful as dispersants.

Anti-wear agents, as their name implies, reduce wear of metal parts. Representatives of conventional anti-wear agents are zinc dialkyldithiophosphates and zinc diaryldithiosphates.

A friction modifier is any material that can alter the coefficient of friction of a surface lubricated by any lubricant or fluid containing such material. Suitable friction modifiers long chain fatty acid derivatives of amines, long chain fatty esters, or derivatives of a long chain fatty epoxides; fatty imidazolines; and amine salts of alkylphosphoric acids. As used herein, the term "fatty" means a carbon chain having 10 to 22 carbon atoms, typically a straight carbon chain. Other known friction modifiers include oil-soluble organo-molybdenum compounds, such as molybdenum dithiocarbamates, dialkyldithiophosphates, alkyl xanthates and alkylthioxanthates.

Antioxidants reduce the tendency of mineral oils during to deteriorate during service. Examples of antioxidants include alkylated diphenylamines (e.g., dinonyl diphenylamine, octyl diphenylamine, dioctyl diphenylamine), phenyl-α-naphthylamine (PANA), and hindered phenols. The hindered phenol antioxidant often contains a secondary butyl and/or a tertiary butyl group as a sterically hindering group. The phenol group may be further substituted with a hydrocarbyl group (typically linear or branched alkyl) and/or a bridging group linking to a second aromatic group. Examples of suitable hindered phenol antioxidants include 2,6-di-tert-butylphenol; 4-methyl-2,6-di-tert-butylphenol; 4-ethyl-2,6-di-tert-butylphenol; 4-propyl-2,6-di-tert-butylphenol; 4-butyl-2,6-di-tert-butylphenol; and 4-dodecyl-2,6-di-tert-butylphenol. Other useful hindered phenol antioxidants include 2,6-di-alkyl-phenolic propionic ester derivatives such as IRGANOX® L-135 (available from BASF) and bis-phenolic antioxidants such as 4,4'-bis(2,6-di-tert-butylphenol) and 4,4'-methylenebis(2,6-di-tert-butylphenol).

Pour point depressants, otherwise known as lube oil flow improvers, lower the temperature at which the fluid will flow or can be poured. Examples include $C_8$ to $C_{18}$ dialkylfumarate vinyl acetate copolymers, polymethacrylates, and wax naphthalene.

Foam control can be provided by an anti-foam agent of the polysiloxane type (e.g., silicone oil and polydimethyl siloxane).

Corrosion inhibitors protect lubricated metal surfaces against chemical attack by water or other contaminants. Suitable corrosion inhibitors include polyoxyalkylene polyols and esters thereof, polyoxyalkylene phenols, thiadiazoles and anionic alkyl sulfonic acids.

Note that many of the additives are shipped from the manufacturer and used with a certain amount of base oil solvent in the formulation. Accordingly, the weight amounts in the table above, as well as other amounts mentioned in this text, unless otherwise indicated are directed to the amount of active ingredient (that is the non-solvent portion of the ingredient). The wt % indicated above is based on the total weight of the lubricating oil composition.

Suitable methods of compounding polymer rheology modifiers into lubricating oil compositions are described in paragraphs [00103]-[00104] of that reference, which description is also incorporated herein.

In some instances, the bimodal copolymer composition may be a suitable ingredient in an "additive package"—a formulation of additives suitable for blending into a lubricating oil composition.

The bimodal copolymer composition of many embodiments may be employed in a lubricating oil composition within a range from a low of about 0.1, 0.5, 1, 1.5, or 2 wt % to a high of 1.0, 1.5, 2.0, 2.5, 3.0, 5.0, 7.0, 10.0 or even 12.0 wt %, provided the high end of the range is greater than the low end, with such wt % based on the total weight of the lubricating oil composition (comprising the bimodal copolymer composition and any other ingredients, e.g., as referenced herein). Deployment of the copolymer composition at levels around 0.1, 0.5, 1.0, 1.5, 2.0, or 2.5 wt % may be preferred in some embodiments. And, according to some embodiments, the copolymer composition may be suitable for forming a concentrate (e.g., for later blending with other components to form a lubricating oil composition, for instance in an additive package) within the range of 5 to 15 wt % copolymer composition in a base oil or basestock.

As noted previously, the bimodal copolymer compositions of many embodiments achieve desirable thickening efficiency (TE) and shear stability index (SSI) performance in a lubricating oil composition. For instance, bimodal copolymers according to some embodiments may exhibit a TE when deployed and tested in a lubricating oil composition of at least 1.9, 2.15, 2.2, 2.25, 2.3, or 2.4, such as within the range from 2.15 to 3.0, more preferably from a low of any one of 2.15, 2.2, 2.25, 2.3, or 2.4 to a high of 2.6, 2.7, 2.8, 2.9, 3.0, or 3.5. TE is measured according to the procedure described previously. Likewise, the same ranges of TE are suitable for target TE values for processes according to various embodiments.

The SSI values of lubricating oils comprising the bimodal copolymer composition are also determined according to previous description. The copolymer compositions of some embodiments, when employed in a lubricating oil, result in such oil having SSI within the range from 29 to 41, preferably 30 to 40, more preferably any one of 32, 33, or 34 to any one of 38, 39, or 40. Target SSIs of processes of various embodiments may be within the range from 10 to 50, preferably 25 to 45 or even 20 to 40, such as within the range from 20 to 30, from 25 to 35, from 30 to 40, and/or from 32 to 37, with ranges from any of the foregoing low ends to any of the foregoing high ends also contemplated in various embodiments.

The above-noted TE measurements may optionally be corrected, or normalized, for the value that would be expected for a given SSI. For instance, a given polymer may exhibit $TE_1$ and SSI of, e.g., 40. The estimated TE that such polymer would exhibit if adjusted to 35 SSI is the corrected TE, or the TE corrected, or normalized, for 35 SSI. The normalization can be developed from models of the expected behavior of various polymers. For instance, for bimodal ethylene-α-olefin copolymers of the present disclosure, a useful TE correction calculation has been found to be: $TE_{corr}=TE_{actual}*(SSI_{desired}/SSI_{actual})^{0.59516}$ $TE_{actual}$ and $SSI_{actual}$ each represent the actual TE and SSI values determined for the polymer; $SSI_{desired}$ is the desired SSI value to which the TE is corrected (e.g., 35 in the example noted above). Thus, a polymer exhibiting 2.4 TE and 38 SSI could be calculated to have an expected $TE_{corr}$ of 2.285 at 35 SSI. This methodology can be helpful in comparing polymers with slightly different SSIs, to provide a normalized basis for comparing different polymers. It is believed that the superior TE imparted upon lubricating oil compositions by copolymer compositions of some embodiments enables lower loading of the copolymer compositions to achieve equally desirable rheology modifying effects. This lower loading, in turn, provides beneficial effects to the lubricating oil composition—such as, for instance, lower amounts of undesired byproduct (e.g., degraded polymer formed during engine use) and can in turn lead to lower soot formation and lower deposits. The lubricating oil compositions comprising the copolymer composition also show advantageously low viscosities in the cold-cranking simulator (CCS) test and the mini-rotary viscometer (MRV). The viscosity in the CCS test can be determined by ASTM D5293. It simulates oil flow during (cold) engine start where the lubricant must be able to freely flow. MRV can be determined using ASTM D4684. The viscosity indicates the pumpability of a multi-grade oil in a vehicle. Both of these values are typically pass/fail with well-known maximum acceptable values; lubricating oil compositions comprising the copolymer compositions of the various present embodiments all exhibit acceptable CCS and MRV results.

Furthermore, the lube oil will have desirably low pour point (as can be measured according to ASTM D97). Pour point may be −36° C. or less in some embodiments, such as −38° C. or less, −40° C. or less, −42° C. or less, or even −45° C. or less in other embodiments.

The lubricating oil comprising the bimodal polymer composition may have a viscosity index, as calculated by the ASTM D2270 method for calculating viscosity index from the kinematic viscosity at 40° C. and 100° C., of at least 100 (e.g., at least 110, at least 120, at least 140, at least 150, or at least 160). Likewise, the lubricating oil may have a viscosity index of 240 or less (e.g., 220 or less, or even 200 or less).

The lubricating oil comprising the bimodal copolymer composition may have a kinematic viscosity at 100° C., as measured by ASTM D445, of at least 2 cSt (e.g., at least 3 cSt, at least 4 cSt, at least 6 cSt, at least 8 cSt, at least 10 cSt, at least 12 cSt, or at least 15 cSt). Likewise, the lubricating oil comprising the bimodal copolymer composition can have a kinematic viscosity at 100° C., as measured by ASTM D445, of 200 cSt or less (e.g., 150 cSt or less, 100 cSt or less, 50 cSt or less, 40 cSt or less, 30 cSt or less, or even 20 cSt or less).

The lubricating oil composition of this disclosure may be identified by viscosity standards of the Society of Automotive Engineers (SAE) for automotive lubricants. As one example, the lubricating composition is identified by the SAE J300 standard, a viscosity classification for engine oils. The J300 viscosity grades of this disclosure are summarized in Table B.

TABLE B

| SAE Viscosity Grade | Low Temp. (° C.) Cranking Viscosity(1), mPa-s Max | Low Temp. (° C.) Pumping Viscosity(2), mPa-s Max with No Yield Stress | Low Shear Rate Kinematic Viscosity(3) ($mm^2/s$) at 100° C. Min | Low Shear Rate Kinematic Viscosity(3) ($mm^2/s$) at 100° C. Max | High Shear Rate Viscosity(4), (mPa-s) at 150° C. Min |
|---|---|---|---|---|---|
| 0 W | 6200 at −35 | 60000 at −40 | 3.8 | — | — |
| 5 W | 6600 at −30 | 60000 at −35 | 3.8 | — | — |
| 10 W | 7000 at −25 | 60000 at −30 | 4.1 | — | — |
| 15 W | 7000 at −20 | 60000 at −25 | 5.6 | — | — |
| 20 W | 9500 at −15 | 60000 at −20 | 5.6 | — | — |
| 25 W | 13000 at −10 | 60000 at −15 | 9.3 | — | — |
| 8 | — | — | 4.0 | <6.1 | 1.7 |
| 12 | — | — | 5.0 | <7.1 | 2.0 |
| 16 | — | — | 6.1 | <8.2 | 2.3 |
| 20 | — | — | 6.9 | <9.3 | 2.6 |
| 30 | — | — | 9.3 | <12.5 | 2.9 |
| 40 | — | — | 12.5 | <16.3 | 3.5(5) |
| 40 | — | — | 12.5 | <16.3 | 3.7(6) |
| 50 | — | — | 16.3 | <21.9 | 3.7 |
| 60 | — | — | 21.9 | <26.1 | 3.7 |

(1)ASTM D5293
(2)ASTM D4684
(3)ASTM D445
(4)ASTM D4683, ASTM D4741, ASTM D5481 or CEC L-36-90
(5)For 0 W-40, 5 W-40 and 10 W-40 grades
(6)For 15 W-40, 20 W-40, 25 W-40 and 40 grades

EXAMPLES

Preparation of Bimodal Copolymer Compositions

Copolymer compositions as described above were synthesized as follows. The copolymer compositions were synthesized in two continuous stirred tank reactors connected in series. The effluent from the first reactor, containing a first copolymer component, unreacted monomers, solvent, and catalyst was fed, with additional monomers, to a second reactor where the polymerization was continued under different process conditions to produce a second copolymer component. The polymerization was performed in solution using isohexane as solvent. During the polymerization process, hydrogen addition and temperature control were used to achieve the desired melt flow rate for each component. The catalyst, activated externally to the reactor, was added as needed in amounts effective to maintain the target polymerization temperature.

In the first reactor, the first copolymer component (also referred to as fraction A) was produced in the presence of ethylene, propylene, and a catalyst comprising the reaction product of N,N-dimethylanilinium tetrakis(pentafluorophenyl)borate activator and 1,1'-bis(4-triethylsilylphenyl)methylene-(cyclopentadienyl)(2,7-di-t-butyl-fluoren-9-yl)hafnium dimethyl catalyst precursor.

In the second reactor, the second copolymer component (also referred to as fraction B) was produced in the presence of ethylene, propylene, and a catalyst comprising the reaction product of activator and catalyst of the same composition as used in the first reactor catalyst.

Reactor pressure was about 1600 psi. Further details for these reaction processes are set forth in Table 1-A below, which reports ethylene (C2) feed, propylene (C3) feed, hexane (solvent) feed, hydrogen ($H_2$) feed, and temperature for each of the first and second reactors in the series polymerizations. The C2, C3, hexane, and $H_2$ feeds are reported in terms of wt % of each feed, on the basis of total feed to both reactor 1 and reactor 2; these numbers may be readily converted to wt % of feed for each reactor if desired, by comparison to only feed inputs to the reactor of interest (Reactor 1 or Reactor 2).

The polymer-containing polymerization mixture, which emerged from the reactors, was quenched to terminate the polymerization reaction, then heated (and pressure reduced) so that two phases of a polymer-rich and polymer-lean phase resulted. The concentrated polymer-rich phase was passed to a low-pressure separator where most of the remaining solvent and monomer were separated from the polymer-rich phase. the resulting polymer was fed into a devolatilization unit where residual monomer and solvent were removed under vacuum and heat, so as to end up with a molten polymer composition containing less than 0.5 wt % of solvent and other volatiles. The molten polymer composition was advanced by a screw to a pelletizer from which the polymer composition pellets are submerged in water and cooled until solid.

on the basis of total mass of fraction A+fraction B in the polymer composition. The MFR values in Table 1-B, unless otherwise indicated, were determined at ASTM D1238, condition L (230° C./2.16 kg). MFRR values are the ratio of MFR (at 230° C./21.6 kg) to MFR (at 230° C./2.16 kg). And, Table 1-B provides viscosity modifier properties (TE, TE corrected to 35 SSI, and SSI values) for a lubricating oil composition comprising 1.5 wt % of the copolymer composition in a Group I base oil having kinematic viscosity at 100° C. of 6.06 cSt (ASTM D445).

Samples 3, 6, and 26-29 correspond to embodiments having a first copolymer component (Fraction A) with very high MFR, and, therefore, higher $MFR_A/MFR_B$ values. These embodiments, as noted, tend to avoid gelation and filter plugging in certain lubricating oil applications, but at the cost of thickening efficiency.

TABLE 1-A

Process Conditions for Various Samples

| Sample | Reactor 1 temp (Fract. A) ° C. | Reactor 2 temp (Fract. B) ° C. | C2 feed to Reactor 1 % of total | C3 feed to Reactor 1 % of total | Hexane feed to Reactor 1 % of total | C2 feed to Reactor 2 % of total | C3 feed to Reactor 2 % of total | Hexane feed to Reactor 2 % of total | $H_2$ feed to Reactor 1 % of total | $H_2$ feed to Reactor 2 % of total |
|---|---|---|---|---|---|---|---|---|---|---|
| 1 | 127.0 | 118.0 | 3.8 | 1.8 | 38.2 | 3.7 | 6.9 | 45.4 | 0.153 | 0.052 |
| 2 | 127.0 | 117.9 | 3.8 | 1.8 | 38.2 | 3.7 | 6.9 | 45.4 | 0.157 | 0.052 |
| 3 | 133.1 | 105.0 | 3.3 | 1.7 | 29.9 | 3.4 | 6.4 | 54.9 | 0.413 | 0.049 |
| 4 | 125.7 | 120.0 | 3.8 | 1.9 | 37.3 | 3.9 | 7.3 | 45.6 | 0.166 | 0.055 |
| 5 | 125.0 | 120.0 | 3.7 | 1.9 | 37.8 | 3.9 | 7.2 | 45.2 | 0.168 | 0.055 |
| 6 | 133.0 | 110.0 | 3.4 | 1.7 | 30.6 | 3.5 | 6.6 | 53.7 | 0.429 | 0.050 |
| 7 | 123.0 | 120.0 | 4.0 | 2.1 | 40.1 | 3.8 | 7.2 | 42.6 | 0.162 | 0.053 |
| 8 | 123.0 | 120.0 | 4.0 | 2.1 | 40.1 | 3.8 | 7.2 | 42.6 | 0.164 | 0.053 |
| 9 | 123.0 | 120.0 | 4.0 | 2.0 | 39.6 | 3.8 | 8.2 | 42.1 | 0.055 | 0.210 |
| 10 | 123.0 | 117.4 | 3.9 | 2.0 | 39.2 | 3.7 | 8.1 | 42.7 | 0.142 | 0.162 |
| 11 | 123.0 | 116.9 | 3.9 | 2.0 | 39.1 | 3.7 | 8.1 | 42.9 | 0.156 | 0.104 |
| 12 | 123.0 | 117.0 | 3.9 | 2.0 | 39.1 | 3.7 | 8.1 | 42.9 | 0.158 | 0.104 |
| 13 | 123.0 | 117.0 | 3.9 | 2.0 | 39.1 | 3.7 | 8.1 | 42.9 | 0.153 | 0.103 |
| 14 | 122.8 | 117.0 | 3.9 | 2.0 | 39.1 | 3.7 | 8.1 | 42.9 | 0.151 | 0.104 |
| 15 | 127.1 | 118.1 | 4.3 | 2.5 | 37.5 | 3.8 | 8.3 | 43.3 | 0.210 | 0.106 |
| 16 | 126.8 | 118.0 | 4.3 | 2.5 | 37.3 | 3.6 | 8.2 | 43.7 | 0.261 | 0.105 |
| 17 | 126.8 | 116.9 | 4.3 | 2.4 | 36.9 | 3.5 | 8.2 | 44.3 | 0.364 | 0.052 |
| 18 | 127.0 | 115.0 | 4.1 | 2.4 | 35.6 | 3.8 | 7.4 | 46.2 | 0.400 | 0.050 |
| 19 | 127.1 | 115.1 | 4.1 | 2.4 | 35.6 | 3.8 | 7.4 | 46.2 | 0.403 | 0.050 |
| 20 | 127.0 | 125.0 | 4.3 | 2.5 | 37.6 | 4.5 | 6.6 | 44.1 | 0.426 | 0.053 |
| 21 | 127.0 | 135.0 | 4.7 | 2.7 | 40.9 | 4.9 | 7.2 | 39.1 | 0.455 | 0.058 |
| 22 | 127.0 | 120.0 | 4.4 | 2.5 | 38.4 | 3.7 | 9.0 | 41.5 | 0.433 | 0.054 |

Table 1-B below summarizes the properties of the copolymer compositions (Samples 1-22) made in accordance with the above-described process, in addition to copolymer composition properties for additional samples (Samples 23-30). In Table 1-B, "pellet" values are indicative of the polymer composition comprising both Fraction A (made in the first reactor) and Fraction B (made in the second reactor). The C2 wt % values for each fraction are reported on the basis for that fraction; the amount of Fraction A (in wt %) is Furthermore, Table 1-C reports DSC data, including $T_g$, $H_f$, and $T_m$, for various of the samples, following the DSC method described previously.

In addition, FIG. 1 is a plot of TE (corr. to 35 SSI) vs. $MFR_A/MFR_B$ for the Sample 1-30 compositions. The plot shows the clear trend of increasing $MFR_A/MFR_B$ leading to decreased TE, affirming a desire to minimize $MFR_A/MFR_B$ where practical (e.g., where gelation avoidance concerns do not militate toward selection of higher-MFR Fraction A).

TABLE 1-B

Example 1 Copolymer Composition Properties

| Sample | Pellet C2 wt % | Pellet MFR g/10 min | Pellet MFRR | Pellet cMFRR at 4.3 MFR | Fract. A C2 wt % | Fract. A MFR g/10 min | Calc'd Fract. B MFR g/10 min | Calc'd Fract. B C2 wt % | Amount Fract. A (%) | $MFR_A/MFR_B$ | $M_w$, LS g/mole | $M_n$, DRI g/mole | Viscosity Mod Tests TE | SSI % | TE corr. to 35SSI |
|---|---|---|---|---|---|---|---|---|---|---|---|---|---|---|---|
| 1 | 58.4 | 2.5 | 35.4 | 31.9 | 72.0 | 4.3 | 1.6 | 47.1 | 45.3 | 2.63 | 104917 | 53667 | 2.20 | 30.0 | 2.37 |
| 2 | 57.2 | 2.9 | 38.0 | 35.3 | 71.3 | 6.1 | 1.6 | 45.6 | 45.3 | 3.80 | 98818 | 50040 | 2.11 | 29.7 | 2.31 |

TABLE 1-B-continued

Example 1 Copolymer Composition Properties

| Sample | Pellet C2 wt % | Pellet MFR g/10 min | Pellet MFRR | Pellet cMFRR at 4.3 MFR | Fract. A C2 wt % | Fract. A MFR g/10 min | Calc'd Fract. B MFR g/10 min | Calc'd Fract. B C2 wt % | Amount Fract. A (%) | $MFR_A/MFR_B$ | $M_w$, LS g/mole | $M_n$, DRI g/mole | Viscosity Mod Tests TE | SSI % | TE corr. to 35SSI |
|---|---|---|---|---|---|---|---|---|---|---|---|---|---|---|---|
| 3 | 57.3 | 1.9 | 37.7 | 31.9 | 71.5 | 17.2 | 0.3 | 46.2 | 43.9 | 51.90 | 123387 | 50470 | 2.36 | 39.9 | 2.18 |
| 4 | 56.5 | 2.6 | 36.3 | 32.8 | 70.9 | 3.2 | 2.2 | 45.7 | 42.9 | 1.49 | 105644 | 54606 | 2.17 | 31.1 | 2.42 |
| 5 | 56.0 | 2.8 | 35.2 | 32.3 | 70.4 | 3.3 | 2.4 | 45.1 | 43.2 | 1.37 | 103495 | 48371 | 2.16 | 30.5 | 2.34 |
| 6 | 56.9 | 2.7 | 34.2 | 31.2 | 71.3 | 14.5 | 0.8 | 46.1 | 42.6 | 18.20 | 115100 | 53932 | 2.21 | 34.6 | 2.22 |
| 7 | 58.7 | 1.3 | 40.1 | 31.6 | 71.7 | 0.9 | 1.8 | 47.9 | 45.3 | 0.49 | 112819 | 48138 | 2.42 | 35.7 | 2.39 |
| 8 | 58.8 | 1.2 | 38.0 | 29.7 | 71.5 | 1.2 | 1.3 | 48.7 | 44.3 | 0.91 | 118411 | 64919 | 2.45 | 35.5 | 2.31 |
| 9 | 56.9 | 1.5 | 37.4 | 30.3 | 71.3 | 0.8 | 2.5 | 45.3 | 44.6 | 0.33 | 120477 | 57655 | 2.41 | 35.1 | 2.45 |
| 10 | 57.0 | 1.6 | 38.8 | 31.7 | 71.3 | 0.9 | 2.4 | 45.4 | 44.6 | 0.38 | 114835 | 62468 | 2.35 | 34.0 | 2.34 |
| 11 | 57.9 | 1.3 | 35.0 | 27.6 | 71.3 | 1.3 | 1.3 | 46.8 | 45.0 | 0.99 | 127087 | 65714 | 2.48 | 37.2 | 2.44 |
| 12 | 58.0 | 1.3 | 37.5 | 29.5 | 71.2 | 1.4 | 1.2 | 47.3 | 44.9 | 1.16 | 124916 | 64246 | 2.50 | 35.9 | 2.42 |
| 13 | 57.3 | 1.4 | 34.7 | 27.9 | 71.2 | 1.4 | 1.5 | 45.9 | 44.9 | 0.94 | 122048 | 65245 | 2.45 | 37.3 | 2.40 |
| 14 | 57.3 | 1.4 | 36.3 | 29.2 | 71.3 | 1.6 | 1.3 | 45.8 | 45.1 | 1.22 | 118198 | 57772 | 2.44 | 36.1 | 2.38 |
| 15 | 59.6 | 1.1 | 36.9 | 28.0 | 71.2 | 1.1 | 1.1 | 49.9 | 45.7 | 1.00 | 129938 | 63391 | 2.54 | 36.9 | 2.44 |
| 16 | 57.7 | 1.3 | 32.2 | 25.4 | 71.3 | 1.1 | 1.6 | 46.4 | 45.5 | 0.69 | 123147 | 66345 | 2.54 | 37.3 | 2.40 |
| 17 | 57.7 | 1.6 | 34.6 | 28.4 | 70.7 | 2.1 | 1.3 | 46.9 | 45.4 | 1.67 | 120964 | 62385 | 2.43 | 36.4 | 2.38 |
| 18 | 56.7 | 1.5 | 34.5 | 28.0 | 71.9 | 2.5 | 1.0 | 44.0 | 45.6 | 2.62 | 120916 | 62119 | 2.47 | 35.9 | 2.34 |
| 19 | 59.3 | 1.3 | 31.1 | 24.5 | 70.9 | 2.7 | 0.7 | 49.7 | 45.2 | 3.85 | 124877 | 56300 | 2.54 | 38.0 | 2.39 |
| 20 | 62.2 | 1.9 | 33.8 | 28.7 | 70.9 | 2.2 | 1.6 | 55.4 | 43.6 | 1.36 | 110133 | 53194 | 2.33 | 31.8 | 2.46 |
| 21 | 62.5 | 4.1 | 29.4 | 29.1 | 71.7 | 1.9 | 7.5 | 55.4 | 43.5 | 0.25 | 90971 | 45526 | 2.10 | 25.9 | 2.52 |
| 22 | 57.4 | 1.9 | 32.4 | 27.5 | 70.7 | 2.0 | 1.8 | 46.1 | 45.9 | 1.14 | 117968 | 61303 | 2.39 | 33.7 | 2.34 |
| 23 | 58.0 | 2.4 | 35.2 | 31.4 | 71.6 | 2.5 | 2.4 | 46.9 | 44.9 | 1.04 | 115,747 | 57,981 | 2.26 | 30.9 | 2.43 |
| 24 | 57.9 | 2.4 | 36.3 | 32.4 | 71.7 | 4.1 | 1.6 | 46.8 | 44.7 | 2.57 | 106,375 | 49,840 | 2.23 | 32.5 | 2.33 |
| 25 | 58.0 | 2.3 | 40.1 | 35.3 | 71.6 | 4.8 | 1.3 | 47.1 | 44.5 | 3.76 | 118,419 | 56,439 | 2.24 | 33.5 | 2.30 |
| 26 | 57.7 | 2.9 | 36.1 | 33.2 | 71.3 | 13.7 | 0.8 | 46.9 | 44.3 | 16.65 | 117,797 | 54,507 | 2.22 | 33.2 | 2.29 |
| 27 | 57.8 | 2.6 | 37.2 | 33.5 | 71.4 | 15.0 | 0.6 | 46.9 | 44.2 | 24.10 | 120,138 | 54,680 | 2.28 | 37.4 | 2.19 |
| 28 | 57.8 | 2.1 | 37.8 | 32.7 | 71.5 | 13.4 | 0.5 | 46.7 | 44.6 | 28.96 | 135,843 | 55,473 | 2.46 | 40.6 | 2.25 |
| 29 | 57.6 | 1.9 | 38.0 | 32.4 | 70.9 | 18.0 | 0.3 | 47.0 | 44.4 | 55.53 | 129,599 | 48,826 | 2.38 | 40.9 | 2.17 |
| 30 | 57.7 | 1.0 | 44.7 | 33.2 | 71.3 | 6.3 | 0.2 | 46.7 | 44.7 | 30.28 | 146,724 | 60,377 | 2.60 | 43.6 | 2.28 |

TABLE 1-C

Example 1 Copolymer DSC Data

| SAMPLE | Cooling Cycle $T_c$ - onset (° C.) | Cooling Cycle $T_c$-peak (° C.) | Cooling Cycle $H_f$ (J/g) | 2nd Heat Cycle $T_g$ (° C.) | 2nd Heat Cycle $T_m$ (° C.) | 2nd Heat Cycle $H_f$ (J/g) | E (C2 content, wt %) | 3.31*E−186 | $T_m$ > 3.31*E−186 | $T_m$ − 10° C. > 3.31*E−186 |
|---|---|---|---|---|---|---|---|---|---|---|
| 10 | 28.5 | 20.0 | 16.4 | −56.0 | 30.8 | 17.2 | 57.0 | 2.7 | Yes | Yes |
| 11 | 29.7 | 21.0 | 15.3 | −56.1 | 33.0 | 16.1 | 57.9 | 5.6 | Yes | Yes |
| 12 | 29.6 | 21.0 | 15.1 | −56.0 | 33.1 | 15.8 | 58.0 | 6.0 | Yes | Yes |
| 13 | 35.4 | 20.4 | 16.3 | −56.3 | 32.1 | 17.1 | 57.3 | 3.7 | Yes | Yes |
| 14 | 28.7 | 20.5 | 15.4 | −56.3 | 32.6 | 16.0 | 57.3 | 3.7 | Yes | Yes |
| 15 | 28.6 | 19.9 | 16.7 | −56.6 | 31.3 | 17.2 | 59.6 | 11.3 | Yes | Yes |
| 17 | 28.5 | 19.5 | 15.9 | −55.5 | 16.3 | 31.5 | 57.7 | 5.0 | Yes | Yes |
| 18 | 28.2 | 19.7 | 15.7 | −56.3 | 30.3 | 16.3 | 56.7 | 1.7 | Yes | Yes |
| 19 | 29.2 | 19.5 | 15.6 | −56.8 | 31.5 | 15.8 | 59.3 | 10.3 | Yes | Yes |
| 21 | 29.3 | 20.9 | 15.4 | −56.1 | 32.0 | 16.0 | 62.5 | 20.9 | Yes | Yes |
| 25 | 34.7 | 19.5 | 16.7 | −55.0 | 29.8 | 18.3 | 58.0 | 5.9 | Yes | Yes |
| 26 | 35.6 | 18.4 | 19.6 | −56.0 | 27.5 | 19.8 | 57.7 | 5.0 | Yes | Yes |
| 28 | 35.2 | 19.0 | 18.2 | −54.7 | 32.0 | 20.5 | 57.8 | 5.2 | Yes | Yes |
| 30 | 31.9 | 19.0 | 15.9 | −55.3 | 32.1 | 16.9 | 57.7 | 5.1 | Yes | Yes |

Performance Testing of Lubricating Oils

Lubricating oil compositions containing a conventional additive package and a viscosity index improver (VII) were blended to meet SAE J300 5W-40 specifications and their low temperature properties were tested, as described in Table 2. The additive package used in the formulations included conventional additives (e.g., one or more of a dispersant, detergent, anti-wear agent, antioxidant, friction modifier, and other optional performance additives) in conventional amounts. Each of the lubricating oils of Comparative Examples 1-5 contained a conventional olefin copolymer VII while each of the lubricating oils of Examples A-C contained the presently described bimodal copolymer composition as the VII.

TABLE 2

Low Temperature Performance of 5 W-40 Lubricating Oils Formulated with Various Olefin Copolymer VIIs

| | VII Ethylene Content (wt %) | Pour Point[a] (° C.) | CCS Viscosity[b] (mPa · s) | MRV Viscosity[c] (mPa · s) | MRV Yield Stress (mPa · s) |
|---|---|---|---|---|---|
| Comparative Ex. 1 | 50 | −36 | 5900 | 38749 | Y ≤35 |
| Comparative Ex. 2 | 44 | −36 | 6087 | 31104 | Y ≤35 |
| Comparative Ex. 3 | 71 | −27 | 4695 | 45351 | 105 < Y ≤ 140 |
| Comparative Ex. 4 | 52 | −39 | 5688 | 30593 | Y ≤35 |
| Comparative Ex. 5 | 59 | −27 | 4996 | 19425 | Y ≤35 |
| Example A | 58 | −39 | 5719 | 25606 | Y ≤35 |
| Example B | 58 | −42 | 5883 | 25675 | Y ≤35 |
| Example C | 58 | −42 | 5641 | 23456 | Y ≤35 |

[a]ASTM D97
[b]Cold Cranking Simulator (CCS) viscosity determined according ASTM D5293.
[c]Mini-Rotary Viscometer (MRV) test results determined according to ASTM D4684.

The results in Table 2 show that lubricating oils containing conventional olefin copolymer VIIs with an ethylene content greater than about 55 wt % exhibited poor performance in terms of MRV viscosity and pour point. In contrast, lubricating oils containing the bimodal copolymer VII of the present disclosure overcome the low temperature performance challenges at comparable or higher ethylene content.

Lubricating oil compositions containing a conventional additive package and a viscosity index improver (VII) were blended to meet SAE J300 5W-40 specifications and were tested for aged-oil low temperature performance, as described in Table 3. In the test methods employed, each lubricating oil is aged in a bench test and then the MRV viscosity is measured. High ethylene polymers are known to have a higher contribution to the thickening of an oil once the oil has been used or oxidized. The additive package used in the formulations included conventional additives (e.g., one or more of a dispersant, detergent, anti-wear agent, antioxidant, friction modifier, and other optional performance additives) in conventional amounts. The lubricating oil of Comparative Example 6 contained a conventional high-ethylene olefin copolymer VII, while the lubricating oil of Example D contained the presently described bimodal copolymer composition as the VII.

TABLE 3

Aged-Oil Low Temperature Performance of 5 W-40 Lubricating Oils with Various Olefin Copolymer VIIs

| | VII Ethylene Content (wt %) | Kinematic Viscosity[a] at 100° C. (cSt) | CEC L-105 MRV Viscosity (mPa · s) | ROBO MRV Viscosity[b] (mPa · s) |
|---|---|---|---|---|
| Comparative Example 6 | 59 | 15.05 | 42700 | 56000 |
| Example D | 58 | 15.10 | 27200 | 32400 |

[a]ASTM D445
[b]ASTM D7528

The results in Table 3 show that the lubricating oil containing the presently described bimodal olefin copolymer VII exhibited superior aged-oil low temperature performance over a lubricating oil containing a conventional high-ethylene VII.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention. All documents described herein are incorporated by reference herein, including any priority documents and/or testing procedures to the extent they are not inconsistent with this text. Likewise, the term "comprising" is considered synonymous with the term "including." Whenever a composition, an element or a group of elements is preceded with the transitional phrase "comprising," it is understood that—unless the context plainly dictates otherwise—we also contemplate the same composition or group of elements with transitional phrases "consisting essentially of," "consisting of," "selected from the group of consisting of," or "is" preceding the recitation of the composition, element, or elements and vice versa.

The invention claimed is:

1. A lubricating oil comprising:

(1) at least 50 wt % of a base oil, based on the weight of the lubricating oil; and (2) a copolymer composition comprising:

(a) 30-70 wt %, based on the weight of the copolymer composition, of a first ethylene-α-olefin copolymer component comprising (i) 50 to 85 wt %, based on the weight of the first ethylene-α-olefin copolymer component, units derived from ethylene and (ii) units derived from a $C_3$-$C_{20}$ α-olefin comonomer, having melt flow rate $MFR_A$ within the range from 0.5 to 9.5 g/10 min (ASTM D1238, 230° C./2.16 kg); and (b) 30-70 wt %, based on the weight of the copolymer composition, of a second ethylene-α-olefin copolymer component comprising (i) 40 to 60 wt %, based on the weight of the second ethylene-α-olefin copolymer component, units derived from ethylene and (ii) units derived from a $C_3$-$C_{20}$ α-olefin comonomer, having $MFR_B$ within the range from 0.1 to 1.75 g/10 min (ASTM D1238, 230° C./2.16 kg); and further wherein the copolymer composition has each of the following: (i) overall ethylene content within the range from 15 to 85 wt %, based on the weight of the copolymer composition; (ii) MFR within the range from 1.0 to 6.0 g/10 min; (iii) corrected Melt Flow Rate Ratio (cMFRR, defined as MFR at 230° C./21.6 kg divided by MFR at 230° C./2.16 kg, ASTM D1238, corrected to a reference MFR of 4.3 g/10 min (230° C./2.16 kg)) within the range from 25 to 45; and (iv) $T_m$>3.31*E−186° C., where E is the ethylene content of the copolymer composition.

2. The lubricating oil of claim 1, wherein each of the first and second ethylene-α-olefin copolymer components comprises units derived from ethylene and units derived from propylene.

3. The lubricating oil of claim 1, wherein the copolymer composition comprises more of the second ethylene-α-olefin copolymer component than first ethylene-α-olefin copolymer component.

4. The lubricating oil of claim 3, wherein the copolymer composition comprises 40 wt % to 50 wt % of the first ethylene-α-olefin copolymer component and 50 wt % to 60 wt % of the second ethylene-α-olefin copolymer component.

5. The lubricating oil of claim 1, wherein the first ethylene-α-olefin copolymer component comprises 67 to 78 wt % ethylene-derived units, and the second ethylene-α-olefin copolymer component comprises 40 to 50 wt % ethylene-derived units, and further wherein the copolymer composition has overall ethylene content greater than or equal to 50 and less than 60 wt %.

6. The lubricating oil of claim 1, wherein the first ethylene-α-olefin copolymer component comprises 67 to 78 wt % ethylene-derived units, and the second ethylene-α-olefin copolymer component comprises 50 to 60 wt % ethylene-derived units;

further wherein the copolymer composition has overall ethylene content within the range from 60 to 65 wt %; and further wherein the copolymer composition has cMFRR within the range from 25 to 35.

7. The lubricating oil of claim 1, wherein the second ethylene-α-olefin copolymer has MFR within the range from 0.1 to 0.99 g/10 min (ASTM D1238, 230° C./2.16 kg).

8. The lubricating oil of claim 1, wherein the first ethylene-α-olefin copolymer has MFR within the range from 0.5 to 4.5 g/10 min (ASTM D1238, 230° C./2.16 kg); and $MFR_A/MFR_B$ within the range from 0.2 to 3.0.

9. The lubricating oil of claim 1, wherein the inter-component MFR ratio $MFR_A/MFR_B$ is within the range from 0.5 to 2.0.

10. The lubricating oil of claim 1, wherein the $MFR_A$ of the first ethylene-α-olefin copolymer component is within the range from 0.7 to 2.5 g/10 min.

11. The lubricating oil of claim 1, wherein the base oil comprises one or more of a Group I base oil, a Group II base oil, a Group III base oil, a Group IV base oil, a Group V base oil.

12. The lubricating oil of claim 1, comprising 0.1 to 12 wt % of the copolymer composition, based on the weight of the lubricating oil.

13. The lubricating oil of claim 1, further comprising one or more of pour point depressants, antiwear agents, antioxidants, other viscosity index improvers, dispersants, corrosion inhibitors, anti-foam agents, detergents, rust inhibitors, and friction modifiers.

14. The lubricating oil of claim 1, wherein the lubricating oil has a shear stability index (SSI) in a range of 25 to 45.

15. The lubricating oil of claim 1, wherein the lubricating oil has a thickening efficiency in a range of 1.9 to 3.5.

16. The lubricating oil of claim 1, wherein the lubricating oil is a crankcase lubricating oil, a marine engine oil, an automatic transmission fluid, a tractor fluid, a hydraulic fluid, a power steering fluid, a gear lubricant, or a pump oil.

* * * * *